US011143987B2

(12) United States Patent
Yoshida et al.

(10) Patent No.: US 11,143,987 B2
(45) Date of Patent: *Oct. 12, 2021

(54) IMAGING FORMING APPARATUS WITH ENHANCED PRIMARY TRANSFERABILITY WHERE PRIMARY TRANSFER IS PERFORMED WITH ELECTRIC CURRENT FLOWING IN CIRCUMFERENTIAL DIRECTION OF INTERMEDIATE TRANSFER BELT

(71) Applicant: CANON KABUSHIKI KAISHA, Tokyo (JP)

(72) Inventors: Tsuguhiro Yoshida, Yokohama (JP); Masaru Shimura, Yokohama (JP); Shinji Katagiri, Yokohama (JP); Eiichi Hamana, Inagi (JP); Takahiro Ikeda, Oyama (JP); Takayuki Tanaka, Tokyo (JP); Shuichi Tetsuno, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/179,635

(22) Filed: Nov. 2, 2018

(65) Prior Publication Data

US 2019/0072880 A1 Mar. 7, 2019

Related U.S. Application Data

(63) Continuation of application No. 15/663,425, filed on Jul. 28, 2017, now Pat. No. 10,168,645.

(30) Foreign Application Priority Data

Jul. 29, 2016 (JP) ..... 2016-149387
Aug. 30, 2016 (JP) ..... 2016-168583
Jun. 14, 2017 (JP) ..... 2017-117141

(51) Int. Cl.
*G03G 15/16* (2006.01)
*G03G 15/00* (2006.01)
(Continued)

(52) U.S. Cl.
CPC ..... *G03G 15/161* (2013.01); *G03G 15/0131* (2013.01); *G03G 15/162* (2013.01);
(Continued)

(58) Field of Classification Search
CPC ..... G03G 15/161; G03G 15/0131
See application file for complete search history.

(56) References Cited

U.S. PATENT DOCUMENTS 5,608,505 A * 3/1997 Takeuchi ..... G03G 15/0131 399/298
7,162,193 B2 * 1/2007 Ozawa ..... G03G 15/1605 399/302
(Continued)

FOREIGN PATENT DOCUMENTS

CN 1058792 C 11/2000
CN 103365173 A 10/2013
(Continued)

*Primary Examiner* — Walter L Lindsay, Jr.
*Assistant Examiner* — Milton Gonzalez
(74) *Attorney, Agent, or Firm* — Canon U.S.A., Inc. I.P. Division

(57) ABSTRACT

An intermediate transfer belt includes a base layer that has ionic conductivity and is a thickest layer out of multiple layers making up the intermediate transfer belt with respect to the thickness direction of the intermediate transfer belt, and an inner layer having electronic conductivity and a lower electrical resistance than the base layer.

20 Claims, 16 Drawing Sheets

(51) Int. Cl.
*G03G 15/01* (2006.01)
*G03G 15/20* (2006.01)

(52) U.S. Cl.
CPC ..... *G03G 15/2053* (2013.01); *G03G 15/5054* (2013.01); *G03G 15/1615* (2013.01); *G03G 2215/0106* (2013.01); *G03G 2215/0132* (2013.01); *G03G 2215/1623* (2013.01); *G03G 2215/1695* (2013.01)

(56) References Cited

U.S. PATENT DOCUMENTS

2004/0013863 A1* 1/2004 Terakawa ..... B32B 7/02
428/212
2013/0259506 A1* 10/2013 Katagiri ..... G03G 15/1675
399/66

FOREIGN PATENT DOCUMENTS

| | | | | |
|---|---|---|---|---|
| JP | 07-044028 | A | | 2/1995 |
| JP | 08110711 | A | * | 4/1996 |
| JP | 2001242725 | A | * | 9/2001 |
| JP | 2004258446 | A | | 9/2004 |
| JP | 3734739 | B2 | | 1/2006 |
| JP | 2010002629 | A | | 1/2010 |
| JP | 2011-085827 | A | | 4/2011 |
| JP | 2012-137733 | A | | 7/2012 |
| JP | 2013231942 | A | | 11/2013 |
| JP | 2014-085618 | A | | 5/2014 |
| JP | 2015232659 | A | * | 12/2015 |

* cited by examiner

FIG. 5

| MEASUREMENT ENVIRONMENT | FIRST EMBODIMENT | | | COMPARATIVE EXAMPLE 1, COMPARATIVE EXAMPLE 2 | |
|---|---|---|---|---|---|
| | VOLUME RESISTIVITY | SURFACE RESISTIVITY | | VOLUME RESISTIVITY | SURFACE RESISTIVITY |
| | | OUTER PERIPHERAL SURFACE | INNER PERIPHERAL SURFACE | | |
| HIGH-TEMPERATURE, HIGH-HUMIDITY ENVIRONMENT (TEMPERATURE 30°C, HUMIDITY 80%) | $1.0\times10^{9}$ Ω·cm | $4.0\times10^{8}$ Ω/□ | $9.5\times10^{5}$ Ω/□ | $1.0\times10^{9}$ Ω·cm | $1.2\times10^{9}$ Ω/□ |
| STANDARD ENVIRONMENT (TEMPERATURE 23°C, HUMIDITY 50%) | $5.0\times10^{9}$ Ω·cm | $3.2\times10^{9}$ Ω/□ | $1.0\times10^{6}$ Ω/□ | $5.0\times10^{9}$ Ω·cm | $6.0\times10^{9}$ Ω/□ |
| LOW-TEMPERATURE, LOW-HUMIDITY ENVIRONMENT (TEMPERATURE 15°C, HUMIDITY 10%) | $2.0\times10^{10}$ Ω·cm | $2.7\times10^{10}$ Ω/□ | $1.5\times10^{6}$ Ω/□ | $2.0\times10^{10}$ Ω·cm | $2.3\times10^{10}$ Ω/□ |

FIG. 6

| MEASUREMENT ENVIRONMENT | CONFIGURATION | IMAGE FORMING UNIT | | | |
|---|---|---|---|---|---|
| | | a | b | c | d |
| HIGH-TEMPERATURE, HIGH-HUMIDITY ENVIRONMENT (TEMPERATURE 30°C, HUMIDITY 80%) | COMPARATIVE EXAMPLE 1 | △ | △ | △ | △ |
| | COMPARATIVE EXAMPLE 2 | □ | □ | ○ | ○ |
| | FIRST EMBODIMENT | ○ | ○ | ○ | ○ |
| STANDARD ENVIRONMENT (TEMPERATURE 23°C, HUMIDITY 50%) | COMPARATIVE EXAMPLE 1 | △ | △ | △ | △ |
| | COMPARATIVE EXAMPLE 2 | ○ | ○ | △ | △ |
| | FIRST EMBODIMENT | ○ | ○ | ○ | ○ |
| LOW-TEMPERATURE, LOW-HUMIDITY ENVIRONMENT (TEMPERATURE 15°C, HUMIDITY 10%) | COMPARATIVE EXAMPLE 1 | △ | △ | △ | △ |
| | COMPARATIVE EXAMPLE 2 | △ | △ | △ | △ |
| | FIRST EMBODIMENT | ○ | ○ | ○ | ○ |

△ ··· IMAGE DEFECTS DUE TO INSUFFICIENT CURRENT
□ ··· IMAGE DEFECTS DUE TO EXCESSIVE CURRENT
○ ··· NO IMAGE DEFECTS

IMAGING FORMING APPARATUS WITH ENHANCED PRIMARY TRANSFERABILITY WHERE PRIMARY TRANSFER IS PERFORMED WITH ELECTRIC CURRENT FLOWING IN CIRCUMFERENTIAL DIRECTION OF INTERMEDIATE TRANSFER BELT

CROSS REFERENCE TO RELATED APPLICATIONS

The present application is a continuation of U.S. patent application Ser. No. 15/663,425, filed Jul. 28, 2017, entitled "IMAGING FORMING APPARATUS WITH ENHANCED PRIMARY TRANSFERABILITY WHERE PRIMARY TRANSFER IS PERFORMED WITH ELECTRIC CURRENT FLOWING IN CIRCUMFERENTIAL DIRECTION OF INTERMEDIATE TRANSFER BELT", the content of which is expressly incorporated by reference herein in its entirety. Further, the present application claims the benefit of Japanese Patent Application No. 2016-149387 filed Jul. 29, 2016, No. 2016-168583 filed Aug. 30, 2016, and No. 2017-117141 filed Jun. 14, 2017, which are hereby incorporated by reference herein in their entirety.

BACKGROUND

Field of the Disclosure

The present disclosure relates to an image forming apparatus that uses electrophotography, such as a copier or printer or the like.

Description of the Related Art

There conventionally have been known color image forming apparatuses that use electrophotography, where toner images are sequentially transferred from image forming units of each color onto an intermediate transfer medium, following which the toner images are transferred to a transfer medium en bloc. In such image forming apparatuses, each image forming unit for each color has a drum-shaped photosensitive member (hereinafter referred to as "photosensitive drum") serving as an image bearing member. Toner images formed on the photosensitive drums of the image forming units are transferred by primary transfer onto the intermediate transfer member such as an intermediate transfer belt or the like, by application of voltage from a primary transfer power source to a primary transfer member provided facing the photosensitive drums, with the intermediate transfer member interposed therebetween. The toner images of these colors that have been transferred from the image forming units of each color onto the intermediate transfer member by primary transfer are then transferred en bloc by secondary transfer from the intermediate transfer member onto a transfer medium such as paper, overhead projector (OHP) sheet, or the like, by application of voltage from a secondary transfer power source to a secondary transfer member at a secondary transfer portion. The toner images of each of the colors transferred onto the transfer medium are then fixed onto the transfer medium by a fixing unit.

Japanese Patent Laid-Open No. 2012-098709 discloses a configuration where an intermediate transfer belt having electrical conductivity is used as the intermediate transfer member, and primary transfer of toner images from multiple photosensitive drums to the intermediate transfer belt is performed by electric current supplied from an electric current supply member flowing in the circumferential direction, along the length, of the intermediate transfer belt. However, there is concern that the configuration in Japanese Patent Laid-Open No. 2012-098709 may have difficulty in securing good primary transferability in a case where electrical resistance of the intermediate transfer belt changes. In a configuration where electric current from the electric current supply member flows in the circumferential direction of the intermediate transfer belt, the distance over which electric current for performing primary transfer flows over the intermediate transfer belt is long. In this case, the voltage at a primary transfer portion where a photosensitive drum and the intermediate transfer belt come into contact (hereinafter referred to as primary transfer voltage) drops by an amount corresponding to the current that has flowed in the circumferential direction of the intermediate transfer belt, so the primary transfer voltage is readily affected by change in the electrical resistance of the intermediate transfer belt.

For example, an intermediate transfer belt made up of multiple layers, of which a layer having ionic conductivity is the thickest in the thickness direction of the intermediate transfer belt, tends to exhibit change in electrical resistance due to the ambient environment. More specifically, in a high-temperature high-humidity environment, the electrical resistance of the intermediate transfer belt tends to become low, while in a low-temperature low-humidity environment, the electrical resistance of the intermediate transfer belt tends to become high. Considering a case of applying a voltage to a current supply member so that the primary transfer voltage is a suitable voltage for performing primary transfer under a standard environment, using such an intermediate transfer belt, the amount of drop of primary transfer voltage in a low-temperature low-humidity environment is greater than the amount of drop of primary transfer voltage in a standard environment, so there is a possibility that the primary transfer voltage necessary for performing the primary transfer of a toner image in a photosensitive drum onto the intermediate transfer belt may be insufficient, which may result in image defects. On the other hand, the amount of drop of primary transfer voltage in a high-temperature high-humidity environment is smaller than the amount of drop of primary transfer voltage in a standard environment, so there is a possibility that primary transfer voltage necessary for performing primary transfer of a toner image in a photosensitive drum onto the intermediate transfer belt may be excessive, which may result in image defects.

SUMMARY

It has been found desirable to secure good primary transferability in an image forming apparatus where primary transfer is performed with electric current flowing in the circumferential direction of an intermediate transfer belt, even in cases where the thickest layer of the layers making up the intermediate transfer belt has ionic conductivity.

An image forming apparatus includes: an image bearing member configured to bear a toner image; an intermediate transfer belt that has electrical conductivity and is configured of a plurality of layers; a current supply member configured to come into contact with the intermediate transfer belt; and a power source configured to apply voltage to the current supply member. An electric current is made to flow in a circumferential direction of the intermediate transfer belt and a toner image is transferred by primary transfer from the image bearing member to the intermediate transfer belt, by applying voltage from the power source to the current supply member. The intermediate belt includes a first layer that has ion conductivity and is a thickest layer out of the plurality of layers making up the intermediate transfer belt with respect to the thickness direction of the intermediate transfer belt, and a second layer having electronic conductivity and a lower electrical resistance than the first layer.

Further features of the present disclosure will become apparent from the following description of exemplary embodiments with reference to the attached drawings.

BRIEF DESCRIPTION OF THE DRAWINGS

FIG. 2A is a schematic diagram illustrating an image forming portion enlarged, and FIG. 2B is a schematic cross-sectional view for describing the layout of members therein.

FIG. 5 is a table for describing change in electrical resistance of intermediate transfer belts in the first embodiment and comparative examples, due to the ambient atmosphere.

FIG. 6 is a table for describing whether or not image defects occur under various measurement environments, in the first embodiment and the comparative examples.

FIG. 12A is a schematic cross-sectional diagram illustrating an image forming apparatus, and FIG. 12B is a schematic diagram for describing the layout of members therein.

FIG. 13A is a schematic cross-sectional view for describing the positional relation between the intermediate transfer belt and a protecting member as viewed from the direction of movement of the intermediate transfer belt, and FIG. 13B is a schematic diagram for describing the configuration of the intermediate transfer belt and protective member.

FIG. 16A is a schematic diagram for describing a cross-section of the intermediate transfer belt as viewed from the direction of movement of the intermediate transfer belt, and FIG. 16B is a schematic diagram for describing the configuration of the intermediate transfer belt.

DESCRIPTION OF THE EMBODIMENTS

Embodiments of the present disclosure will be described exemplarity in detail with reference to the drawings. It should be noted, however, dimensions, materials, and shapes, of components described in the following embodiments, and relative layouts among the components, should be changed as appropriate in accordance with configurations of apparatuses to which the present disclosure is applied, and with various conditions. Accordingly, the embodiments do not restrict the scope of the present disclosure, unless specifically stating so.

First Embodiment

Configuration of Image Forming Apparatus

Figure 1:
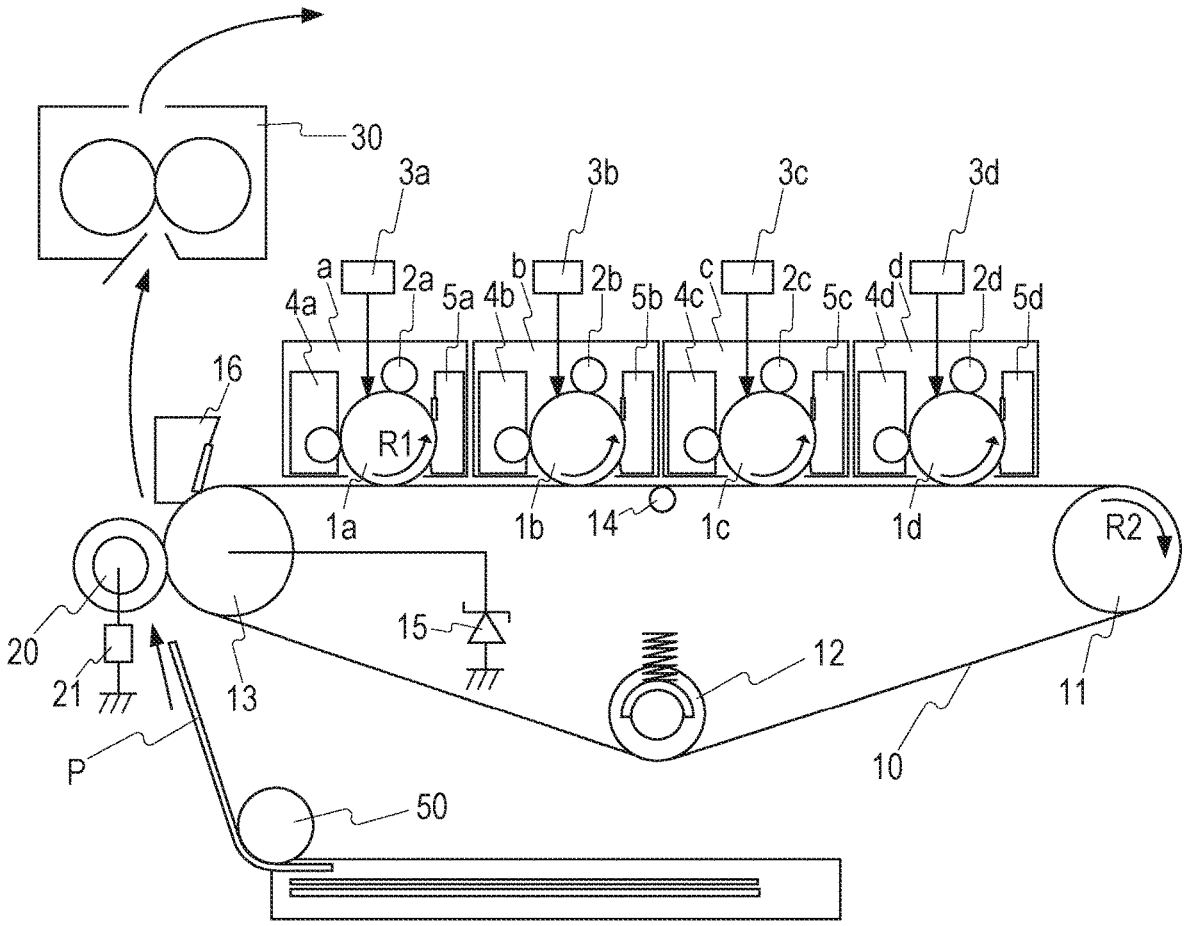
FIG. 1 is a schematic cross-sectional view for describing an image forming apparatus according to a first embodiment.

FIG. 1 is a schematic cross-sectional diagram illustrating the configuration of an image forming apparatus according to a first embodiment. Note that the image forming apparatus according to the present embodiment is a so-called tandem type image forming apparatus, where multiple image forming units "a" through "d" are provided. A first image forming unit a forms images using yellow (Y) toner, a second image forming unit b using magenta (M) ink, a third image forming unit c using cyan (C) ink, and a fourth image forming unit d using black (Bk) ink. These four image forming units are laid out in one row equidistant from adjacent image forming units, much of the configurations of the image forming units being substantially in common except for the color of toner accommodated. Accordingly, the image forming apparatus according to the present embodiment will be made by using the first image forming unit a.

The first image forming unit a has a photosensitive drum 1*a* that is a drum-shaped photosensitive member, a charging roller 2*a* that is a charging member, a developing device 4*a*, and a drum cleaning device 5*a*. The photosensitive drum 1*a* is an image bearing member that bears a toner image, and is rotationally driven in the direction of arrow R1 in FIG. 1 at a predetermined circumferential speed (process speed). The developing device 4*a* accommodates yellow toner, and develops yellow toner on the photosensitive drum 1*a*. The drum cleaning device 5*a* is a device for recovering toner that has adhered to the photosensitive drum 1*a*. The drum cleaning device 5*a* has a cleaning blade that comes into contact with the photosensitive drum 1*a*, and a waste toner box that accommodates toner and the like removed from the photosensitive drum 1*a* by the cleaning blade.

Image forming operations are started by a control unit (omitted from illustration) such as a controller or the like receiving image signals, and the photosensitive drum 1*a* is rotationally driven. The photosensitive drum 1*a* is uniformly charged to a predetermined voltage (charging bias) of a predetermined polarity (negative polarity in the present embodiment) by the charging roller 2*a* in the process of rotating, and exposed by an exposing device 3*a* in accordance with image signals. Accordingly, an electrostatic latent image, corresponding to a yellow color component image of the intended color image, is formed on the photosensitive drum 1*a*. The electrostatic latent image is then developed by the developing device 4*a* at a developing position, and is visualized on the photosensitive drum 1*a* as a yellow toner image. Now, the regular charging polarity of the toner accommodated in the developing device 4*a* is negative polarity, and the electrostatic latent image is reverse-developed by toner charged by the charging roller 2*a* to the same polarity as the charging polarity of the photosensitive drum 1*a*. However, the present disclosure is not restricted to this arrangement, and the present disclosure can be applied to an image forming apparatus where electrostatic latent images are positive-developed by toner charged to the opposite polarity from the charging polarity of the photosensitive drum 1*a*.

An endless and rotatable intermediate transfer belt 10 has electrical conductivity. The intermediate transfer belt 10 comes into contact with the photosensitive drum 1*a* to form a first transfer portion, and is rotationally driven at generally the same circumferential speed as the photosensitive drum 1*a*. The intermediate transfer belt 10 is stretched around an opposed roller 13 serving as an opposed member, and a drive roller 11 and a tension roller 12 serving as tensioning members. The yellow toner image formed on the photosensitive drum 1*a* is transferred by primary transfer from the photosensitive drum 1*a* to the intermediate transfer belt 10 while passing the first transfer portion. Primary transfer residual toner residing on the surface of the photosensitive drum 1*a* is removed by the drum cleaning device 5*a* cleaning the photosensitive drum 1*a*, and is used in the image forming process following charging.

Current is supplied to the intermediate transfer belt 10 when performing primary transfer, from a secondary transfer roller 20 serving as a secondary transfer member (current supply member) coming into contact with the outer peripheral surface of the intermediate transfer belt 10. The toner image is transferred by primary transfer from the photosensitive drum 1*a* to the intermediate transfer belt 10, due to electric current supplied from the secondary transfer roller 20 flowing in the circumferential direction of the intermediate transfer belt 10. Primary transfer of toner images at the primary transfer portions in the present embodiment will be described in detail later.

Subsequently, a magenta toner image of a second color, a cyan toner image of a third color, and a black toner image of a fourth color, are formed in the same way, and are sequentially transferred so as to be overlaid on the intermediate transfer belt 10. Thus, toner images of four colors that correspond to the intended color image are formed on the intermediate transfer belt 10. The toner images of four colors borne by the intermediate transfer belt 10 are transferred en bloc by secondary transfer to the surface of a transfer medium P, such as a paper or OHP sheet or the like fed from a sheet feeding device 50, while passing a secondary transfer portion formed where the secondary transfer roller 20 and the intermediate transfer belt 10 come into contact.

The secondary transfer roller 20 that is used has been manufactured by covering a nickel-plated steel bar that has an outer diameter of 6 mm with a foamed sponge member, so that the outer diameter thereof is 18 mm. The main components of the foamed sponge member are nitrile rubber (NBR) and epichlorohydrin rubber, adjusted to volume resistivity of $10^8$ Ω·cm and a thickness of 6 mm. The rubber hardness of the foamed sponge member was measured using an ASKER Durometer Type C, and found to have a hardness of 30° under a load of 500 g. The secondary transfer roller 20 is in contact with the outer peripheral surface of the intermediate transfer belt 10, and forms the secondary transfer portion by being pressed against the opposed roller 13, serving as an opposed member across the intermediate transfer belt 10, at a pressure of 50 N.

The secondary transfer roller 20 rotates following the intermediate transfer belt 10. Current flows from the secondary transfer roller 20 toward the opposed roller 13 serving as an opposed member, due to voltage being applied to the secondary transfer roller 20 from a transfer power source 21. Accordingly, the toner images borne by the intermediate transfer belt 10 are transferred into the transfer medium P at the second transfer portion. Note that the voltage being applied from the transfer power source 21 to the secondary transfer roller 20 is controlled when the toner images on the intermediate transfer belt 10 are being transferred onto the transfer medium P, so that the current flowing from the secondary transfer roller 20 toward the opposed roller 13 via the intermediate transfer belt 10 is constant. The magnitude of the current for performing secondary transfer is decided beforehand in accordance with the ambient atmosphere in which the image forming apparatus is installed, and the type of transfer medium P. The transfer power source 21 is connected to the secondary transfer roller 20, and applies transfer voltage to the secondary transfer roller 20. The transfer power source 21 is capable of output in the range of 100 V to 4000 V.

The transfer medium P on which toner images of four colors have been transferred by secondary transfer is thereafter subjected to heating and pressuring at a fixing unit 30, whereby the toners of the four colors are fused and mixed, and thus fixed onto the transfer medium P. Toner remaining on the intermediate transfer belt 10 after the secondary transfer is removed by a belt cleaning device 16, provided facing the opposed roller 13 across the intermediate transfer belt 10, cleaning the intermediate transfer belt 10. The belt cleaning device 16 has a cleaning blade that comes into contact with the outer peripheral surface of the intermediate transfer belt 10 and a waste toner container that accommodates toner removed from the intermediate transfer belt 10 by the cleaning blade. Thus, the image forming apparatus according to the present embodiment forms full-color print images by the operations described above.

Next, description will be made regarding the intermediate transfer belt 10, drive roller 11, tension roller 12, opposed roller 13 serving as an opposed member as to the secondary transfer roller 20, and a metal roller 14 serving as a contact member coming into contact with the inner peripheral surface of the intermediate transfer belt 10. The intermediate transfer belt 10 is an endless belt, formed of a resin material to which a conducting agent has been added to impart electrical conductivity. The intermediate transfer belt 10 is stretched over the three axes of the drive roller 11, tension roller 12, and opposed roller 13, and is tensioned to a tensile force of 60 N total pressure by the tension roller 12.

The opposed roller 13 is grounded via a Zener diode 15 serving as a voltage maintaining element. Current flows to the Zener diode 15 via the opposed roller 13, due to the secondary transfer roller 20, to which the transfer power source 21 has applied voltage, supplying current to the opposed roller 13. The Zener diode 15 serves as a voltage maintaining element is an element that maintains a predetermined voltage (hereinafter referred to as Zener voltage) by a current flowing thereat, and generates Zener voltage at the cathode side in a case where a predetermined or greater current flows. That is to say, one end side (the anode side) of the Zener diode 15 is grounded, and the other end side (the cathode side) is connected to the opposed roller 13. The opposed roller 13 is maintained at Zener voltage due to voltage being applied from the transfer power source 21 to the secondary transfer roller 20.

The toner images of each of the photosensitive drums 1*a* through 1*d* are transferred by primary transfer onto the photosensitive drums 1*a* through 1*d* in the present embodiment, due to current flowing from the opposed roller 13 maintained at Zener voltage to the photosensitive drums 1*a* through 1*d* via the intermediate transfer belt 10. The Zener voltage is set to 300 V in the present embodiment to obtain desired primary transfer efficiency.

The intermediate transfer belt 10 is rotationally driven at generally the same circumferential speed as the photosensitive drums 1*a* through 1*d*, by the drive roller 11 that rotates in the direction of arrow R2 in FIG. 1 under driving force from a drive source (omitted from illustration), as illustrated in FIG. 1. Also illustrated in FIG. 1 is the metal roller 14, serving as a contact member that comes into contact with the inner peripheral surface of the intermediate transfer belt 10, being disposed between the photosensitive drum 1*b* and photosensitive drum 1*c*.

Figure 2A:
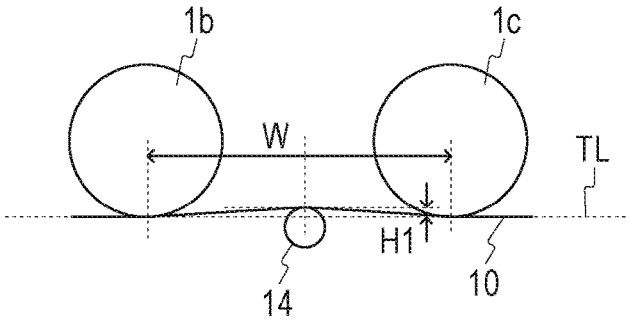
FIGS. 2A and 2B are schematic diagrams illustrating the first embodiment, where

FIG. 2A is a schematic diagram illustrating between the photosensitive drum 1*b* and the photosensitive drum 1*c* in an enlarged manner. It can be seen from FIG. 2A that the metal roller 14 is disposed at an intermediate position between the photosensitive drum 1*b* and the photosensitive drum 1*c*. The metal roller 14 is also disposed at a position closer toward the photosensitive drums from an imaginary line TL connecting positions where the photosensitive drum 1*b* and 1*c* come into contact with the intermediate transfer belt 10, to ensure that the intermediate transfer belt 10 follows the contours of the photosensitive drum 1*b* and 1*c* for a certain amount.

The metal roller 14 is configured as a straight and cylindrical nickel-plated stainless steel rod, 6 mm in outer diameter, and rotates following rotation of the intermediate transfer belt 10. The metal roller 14 is in contact with the intermediate transfer belt 10 over a predetermined region on a longitudinal direction orthogonal to the direction of movement of the intermediate transfer belt 10, and is disposed in an electrically floating state.

Now, the distance from the axial center of the photosensitive drum 1*b* to the axial center of the photosensitive drum 1*c* is defined as W, and the amount of lifting of the intermediate transfer belt 10 by the metal roller 14 as to the imaginary line TL as H1. In the present embodiment, W=50 mm and H1=2 mm. The photosensitive drums 1*a* through 1*d* are all equidistant, being set to distance W=50 mm.

Figure 2B:
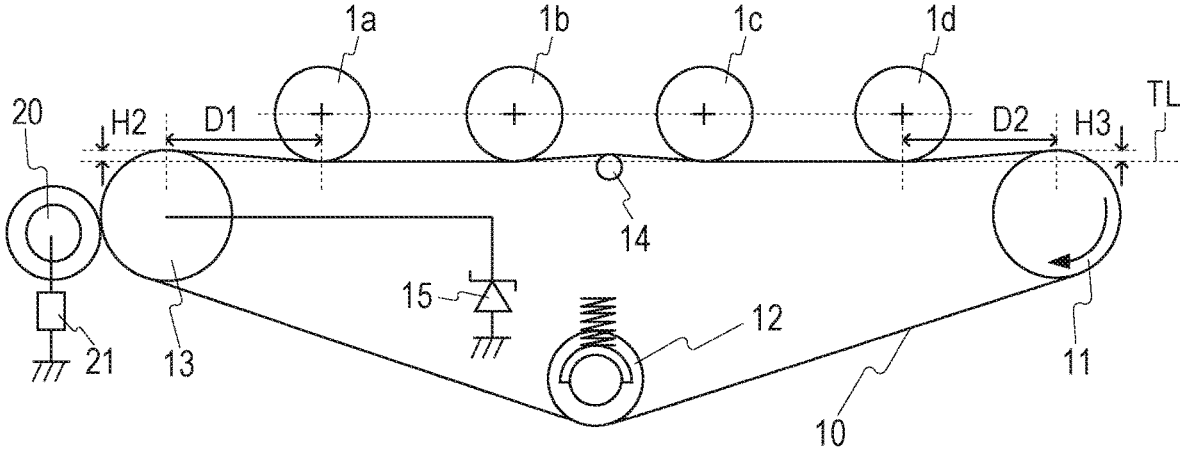

FIG. 2B is a schematic cross-sectional view illustrating the configuration of the first transfer unit according to the present embodiment. The drive roller 11 and opposed roller 13 are disposed as illustrated in FIG. 2B in the present embodiment, in order to ensure that the intermediate transfer belt 10 follows the contours of the photosensitive drum 1*a* and 1*d* for a certain amount. The drive roller 11 and opposed roller 13 are also disposed at positions closer toward the photosensitive drums from the imaginary line TL connecting positions where the photosensitive drums 1*a*, 1*b*, 1*c*, and 1*d* come into contact with the intermediate transfer belt 10. The distance from the axial center of the opposed roller 13 to the axial center of the photosensitive drum 1*a* is defined as D1, and the distance from the axial center of the drive roller 11 to the axial center of the photosensitive drum 1*d* is defined as D2. The amount of lifting of the intermediate transfer belt 10 by the opposed roller 13 as to the imaginary line TL is defined as H2, and the amount of lifting by the drive roller 11 as H3. D1=D2=50 mm, and H2=H3=2 mm in the present embodiment.

Configuration of Intermediate Transfer Belt

Figure 3:
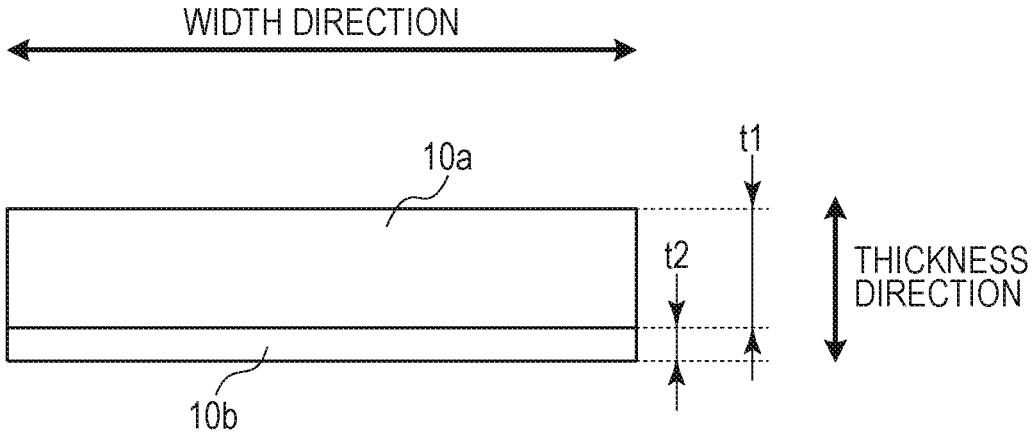
FIG. 3 is a schematic diagram for describing a cross-section of an intermediate transfer belt in the first embodiment.

FIG. 3 is a schematic diagram illustrating a cross-section of the intermediate transfer belt 10 according to the present embodiment, as viewed form the axial direction of the metal roller 14. The intermediate transfer belt 10 has a circumferential length of 700 mm and a thickness of 90 μm, and is formed of a base layer 10*a* (first layer) and an inner layer 10*b* (second layer). An endless belt of polyvinylindene difluoride (PVDF) with an ion conducive agent such as a multivalent metal salt or quaternary ammonium salt mixed in as a conducting agent is used for the base layer 10*a*, and an acrylic resin in which carbon is mixed in as a conducting agent is used for the inner layer 10*b*.

The base layer is defined here as the thickest layer of the layers making up the intermediate transfer belt 10, with regard to the thickness direction of the intermediate transfer belt 10. The inner layer 10*b* in the present embodiment is a layer formed on the inner peripheral surface side of the intermediate transfer belt 10, and the base layer 10*a* is formed at a position closer to the photosensitive drums 1*a* through 1*d* than the inner layer 10*b*, with regard to the thickness direction that is a direction intersecting the direction of movement of the intermediate transfer belt 10. The inner layer 10*b* of the intermediate transfer belt 10 was formed in the present embodiment by spray coating on the base layer 10*a*. Defining the thickness of the base layer 10*a* as t1 and the thickness of the inner layer 10*b* as t2, t1=87 μm and t2=3 μm.

Although polyvinylindene difluoride (PVDF) was used in the present embodiment as the material for the base layer 10*a*, this is not restrictive. For example, materials such as polyester, acrylonitrile butadiene styrene copolymer (ABS), and so forth, and mixed resins thereof, may be used. Although acrylic resin was used in the present embodiment as the material for the inner layer 10*b*, other materials may be used such as polyester or the like, for example.

High molecular and low molecular conducting agents can be used as the ion conductive agent to add to the base layer 10*a*. Examples of high molecular forms that can be used include nonionic substances such as polyether esteramide, polyethylene oxide—epichlorohydrin, and polyether ester, cationic substances such as acrylate polymers containing quaternary ammonium salts, and anionic substances such as polystyrene sulfonate and so forth. Examples of low molecular forms that can be used include nonionic substances such as derivatives including ether and derivatives including etherester, cationic substances such as primary through tertiary ammonium salts, quaternary ammonium salts, and derivatives thereof, and anionic substances such as carboxylate, sulfuric acid salts, sulfonate, phosphoric acid ester salts, derivatives thereof, and so forth. Note that these high-molecular or low-molecular ion conductive agents may be used singularly or as a combination of two or more types. Particularly, quaternary ammonium salts, sulfonate, polyether ester amide, or the like, are suitably used from the perspective of heat resistance and electrical conductivity.

Figure 4A:
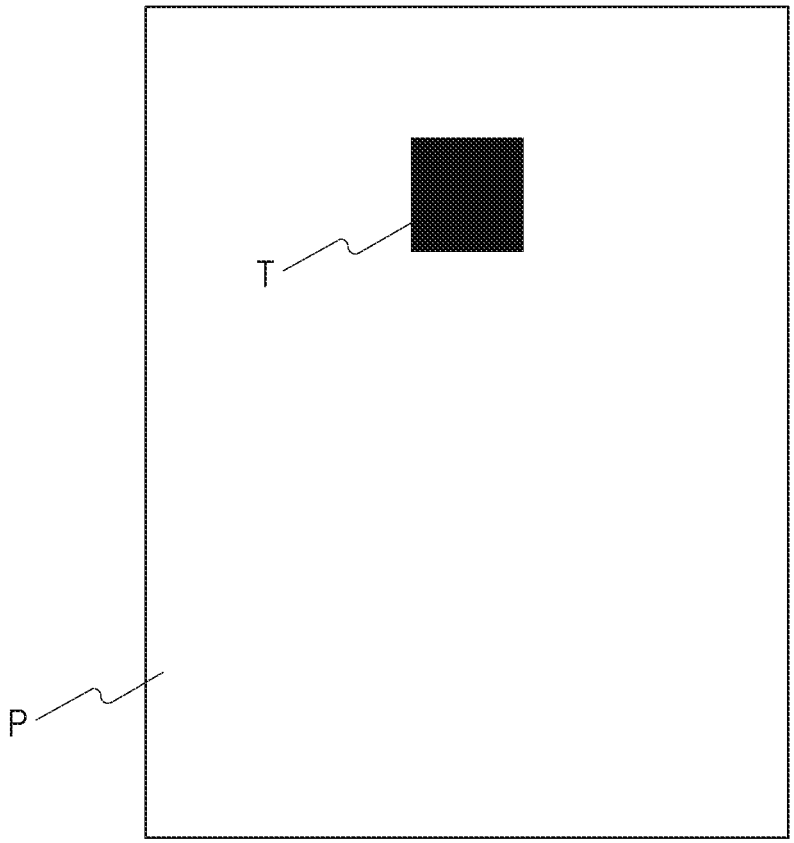
FIGS. 4A and 4B are schematic diagrams for describing secondary transferability of an independent patch pattern.
Figure 4B:
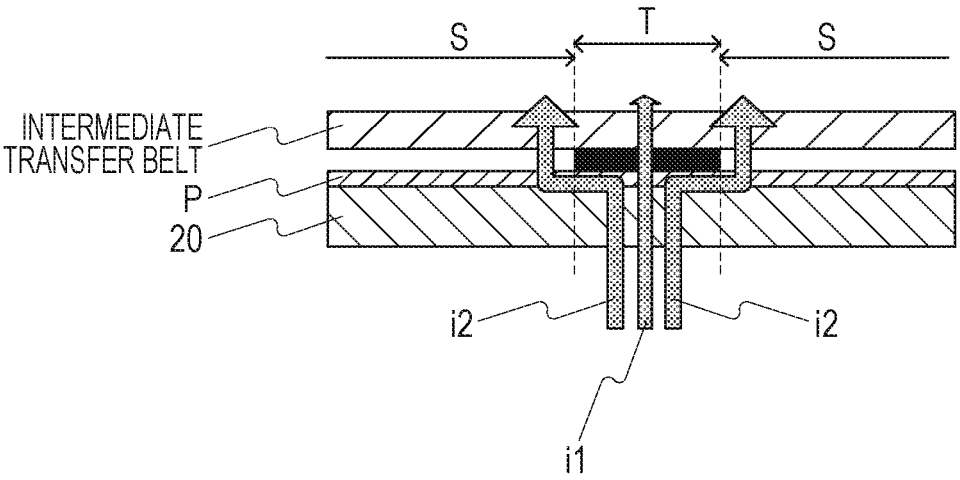

The base layer 10*a* of the intermediate transfer belt 10 has ionic conductivity. An intermediate transfer belt that has ionic conductivity has a characteristic of having better secondary transferability regarding an isolated patch-shaped toner image (hereinafter referred to as independent patch pattern) as compared to an intermediate transfer belt made of an electronically conductive material. FIGS. 4A and 4B are schematic diagrams for describing secondary transferability of an independent patch pattern.

For example, transfer defects readily occur with independent patch patterns such as that illustrated in FIG. 4A, at the time of transfer from the intermediate transfer belt to the transfer medium P. Electrical resistance in a non-toner region S is lower than a toner image region T with regard to an independent patch pattern as illustrated in FIG. 4B, so current for performing secondary transfer may selectively flow to the non-toner region S. As a result, there is a possibility that secondary transfer of the independent patch pattern to the transfer medium will not be performed, and a transfer defect will occur.

When great current flows through an electronically conductive intermediate transfer belt, the electrical resistance value drops due to the electric properties thereof, so a current i2 flowing to the non-toner region S at both sides of the independent patch pattern increases. On the other hand, change in electrical resistance due to the amount of current flowing tends to be smaller in an ion conductive intermediate transfer belt as compared to an electronically conductive intermediate transfer belt. Accordingly, excessive current i2 can be suppressed from flowing to the non-toner region S, and current i1 can be made to flow to the toner image region T. Accordingly, transfer defects do not readily occur in secondary transfer. Even in a case where the intermediate transfer belt is configured of multiple layers, advantages of reduced secondary transfer defect can be obtained by providing an ion conductive layer near the surface layer of the intermediate transfer belt. Note that secondary transfer defects can be reduced with an intermediate transfer belt having an electronically conductive layer near the surface layer, depending on the electrical resistance of the electronically conductive layer.

The intermediate transfer belt 10 used in the present embodiment has different electrical resistance between the base layer 10*a* and the inner layer 10*b*. The electrical resistance of the inner layer 10*b* is lower than that of the base layer 10*a*. With regard to the intermediate transfer belt 10, the surface resistivity as measured from the outer peripheral surface side (base layer 10*a* side) will be defined as electrical resistance of the base layer 10*a*, and the surface resistivity as measured from the inner peripheral surface side (inner layer 10*b* side) will be defined as electrical resistance of the inner layer 10*b*. That is to say, the surface resistivity measured from the outer peripheral surface side and the surface resistivity measured from the inner peripheral surface side differ in the intermediate transfer belt 10 according to the present embodiment, with the surface resistivity measured from the inner peripheral surface side being a smaller value than the surface resistivity measured from the outer peripheral surface side.

Further, the volume resistivity of the intermediate transfer belt 10 according to the present embodiment reflects the electrical resistance of the base layer 10*a*, from the relationship between the electrical resistance and thickness of the base layer 10*a* and inner layer 10*b*. In a standard environment (temperature of 23° C. and humidity of 50%), the surface resistivity measured from the outer peripheral surface side of the intermediate transfer belt 10 is $3.2\times10^9$ Ω/□, the surface resistivity measured from the inner peripheral surface side of the intermediate transfer belt 10 is $1.0\times10^6$ Ω/□, and the volume resistivity is $5\times10^6$ Ω·cm.

The volume resistivity and the surface resistivity of the intermediate transfer belt 10 were measured under a measurement environment of temperature of 23° C. and humidity of 50%, using a Hiresta-UP (MCP-HT450) manufactured by Mitsubishi Chemical Corporation. Measurement of volume resistivity was performed using a ring probe type UR (model MCP-HTP12) touching the intermediate transfer belt 10 from the outer peripheral surface side, under conditions of applied voltage of 100 V and measurement time of 10 seconds. Measurement of surface resistivity was performed using a ring probe type UR100 (model MCP-HTP16), under conditions of applied voltage of 10 V and measurement time of 10 seconds. Measurement of surface resistivity of the inner peripheral surface of the intermediate transfer belt 10 was performed with the probe touching the inner layer 10*b* side, and measurement of surface resistivity of the outer peripheral surface of the intermediate transfer belt 10 was performed with the probe touching the base layer 10*a* side.

The effects of the present embodiment will be described below in detail using a comparative example 1 and a comparative example 2. For the comparative example 1, an intermediate transfer belt was used that has the same material and shape as the base layer 10*a* in the present embodiment, but the inner layer 10*b* was not provided. The Zener voltage of the Zener diode was set to 300 V in the comparative example 1. Except for the configuration of the intermediate transfer belt 10, all other configuration of the image forming apparatus and the various setting values are the same as in the present embodiment. Comparative example 2 used the same intermediate transfer belt as comparative example 1, but the Zener voltage of the Zener diode was set to 500 V. Except for the configuration of the intermediate transfer belt 10 and the Zener voltage, all other configuration of the image forming apparatus and the various setting values of comparative example 2 are the same as in the present embodiment.

FIG. 5 is a table for describing the volume resistivity and surface resistivity of the intermediate transfer belt 10 according to the present embodiment and the intermediate transfer belt according to comparative example 1 and comparative example 2, under each measurement environment. It can be seen from FIG. 5 that the volume resistivity of the intermediate transfer belt 10 according to the present embodiment and the intermediate transfer belt according to comparative example 1 and comparative example 2 are almost the same values under each measurement environment. The reason is that the electrical resistance of the inner layer 10*b* of the intermediate transfer belt 10 according to the present embodiment is sufficiently low as compared to the electrical resistance of the base layer 10*a*, and the volume resistivity of the intermediate transfer belt 10 according to the present embodiment reflects the electrical resistance of the base layer 10*a*.

On the other hand, as a result of providing the inner layer 10*b*, the surface resistivity at the inner peripheral surface side of the intermediate transfer belt 10 according to the present embodiment is lower than the surface resistivity on the inner peripheral surface side of the intermediate transfer belt according to comparative example 1 and comparative example 2 (hereinafter referred to simply as surface resistivity). In this way, the intermediate transfer belt 10 that has different electrical resistance between the base layer 10*a* and the inner layer 10*b* is used in the present embodiment, and the electrical resistance of the inner layer 10*b* is set lower as compared to the base layer 10*a*.

The inner layer 10*b* of the intermediate transfer belt 10 according to the present embodiment has electronic conductivity, so the surface resistivity at the inner peripheral surface side of the intermediate transfer belt 10 is not affected by the ambient environment, and there is hardly any change in each of the measurement environments. On the other hand, the intermediate transfer belt according to comparative example 1 and comparative example 2 do not have the inner layer 10*b*, and is only configured of a base layer having ionic conductivity, so the closer to the high-temperature high-humidity environment (temperature of 30° C. and humidity of 80%) it gets, the lower the surface resistivity is.

FIG. 6 is a table for describing primary transferability when performing image formation at each image forming unit under each measurement environment, using the configurations of the present embodiment, comparative example 1, and comparative example 2. For the verification of primary transferability illustrated in FIG. 6, the transfer medium P used was letter-size (216 mm in width) Business 4200 (grammage of 75 g/m$^2$) produced by Xerox Corporation, stored under each measurement environment, and the print mode was simplex print mode. With regard to the photosensitive drums 1*a* through 1*d*, the images used for verifying primary transferability were an image formed by forming a partial solid image and thereafter forming a halftone image, and a secondary color image where solid images of toner of two colors are overlaid (hereinafter referred to as secondary color image). A secondary color image here means an image of red (R), green (G), and blue (B), having average density of 200%.

Figure 7:
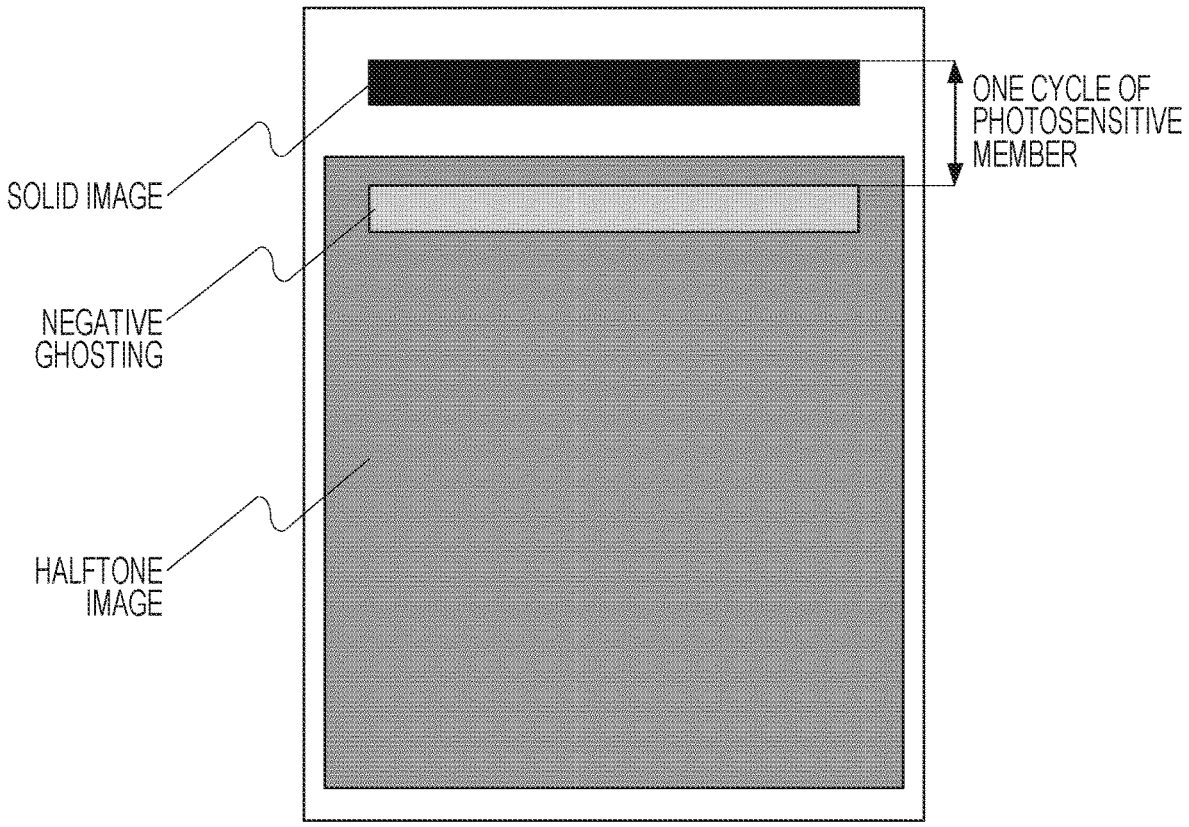
FIG. 7 is a schematic diagram for describing a negative ghost, which is an image defect occurring when verifying primary transferability.

The circles in FIG. 6 indicate that no image defects occurred. The squares in FIG. 6 indicate that excessive current flowed to the photosensitive drum due to the voltage formed at the primary transfer unit (hereinafter referred to as primary transfer voltage) being high, FIG. 7 being a schematic diagram for describing the image defects observed at this time. The triangles in FIG. 6 indicate that insufficient current flowed to the photosensitive drum due to the primary transfer voltage at the primary transfer unit being low.

When excessive current flows to the photosensitive drum, more current flows to portions not bearing toner images (non-image portion) than to portions bearing toner images (image portion), resulting in potential difference in the surface potential of the photosensitive drum. Even after the photosensitive drum is charged by the charging roller, the potential difference formed on the photosensitive drum at the time of passing through the primary transfer portion remains, and difference in concentration occurs on the photosensitive drum when developing the toner image. That is to say, the potential difference formed by excessive current flowing to the photosensitive drum when passing the primary transfer portion generates image defects called "negative ghosts" where the image portion of the previous cycle of the photosensitive drum appears whitish in the subsequent cycle thereof, as seen from FIG. 7.

On the other hand, when the current flowing to the photosensitive drum is insufficient, the transfer percentage of the toner image being transferred by primary transfer from the photosensitive drum to the intermediate transfer belt deteriorates. In this case, transfer voids occur at the image forming unit where the transfer percentage has dropped, and image defects occur due to insufficient primary transfer of the secondary color image of red (R), green (G), and blue (B).

It can be seen from FIG. 6 that image defects were observed at images formed by all image forming units in comparative example 1. The reason is that current flowing in the circumferential direction of the intermediate transfer belt of comparative example 1 resulted in the primary transfer voltage of each image forming unit a through d to drop below the Zener voltage (300 V) at the opposed roller 13, so the current flowing to the photosensitive drum 1 was insufficient.

With regard to the configuration of comparative example 2, no image defects were observed in images formed at the image forming unit a and image forming unit b at the standard environment (temperature of 23° C. and humidity of 50%), but image defects were observed in images formed at the image forming unit c and image forming unit d. The reason is that, in the same way as with comparative example 1, current flowing in the circumferential direction of the intermediate transfer belt resulted in the primary transfer voltage at the image forming unit c and image forming unit d, which are farther away from the opposed roller 13, to drop below the Zener voltage (500 V) at the opposed roller 13. Particularly, the voltage drop due to current flowing in the circumferential direction of the intermediate transfer belt was great at the low-temperature low-humidity environment (temperature of 15° C. and humidity of 10%) where the electrical resistance of the intermediate transfer belt is high, so image defects were observed at all image forming units, which can be seen in FIG. 6.

Image defects were not observed at the image forming unit c and image forming unit d, which are farther away from the opposed roller 13 in the configuration of comparative example 2, under the high-temperature high-humidity environment (temperature of 30° C. and humidity of 80%) where the electrical resistance of the intermediate transfer belt is low. However, image defects were observed at the image forming unit a and image forming unit b, which are closer to the opposed roller 13, due to the electrical resistance of the intermediate transfer belt being low as to the Zener voltage, and excessive current flowing to the image forming unit a and image forming unit b. Thus, the electrical resistance of the ion conductive intermediate transfer belt of comparative example 1 and comparative example 2 changed due to the ambient environment, and there were cases where it was difficult to obtain appropriate primary transfer voltage at the image forming units.

In comparison with this, no image defects due to change in ambient environment occurred with the configuration according to the present embodiment, as can be seen from FIG. 6. This is because the intermediate transfer belt 10 according to the present embodiment has the inner layer 10*b* that is lower in electrical resistance than the base layer 10*a* and also having electronic conductivity, is provided on the inner peripheral surface side.

Figure 8:
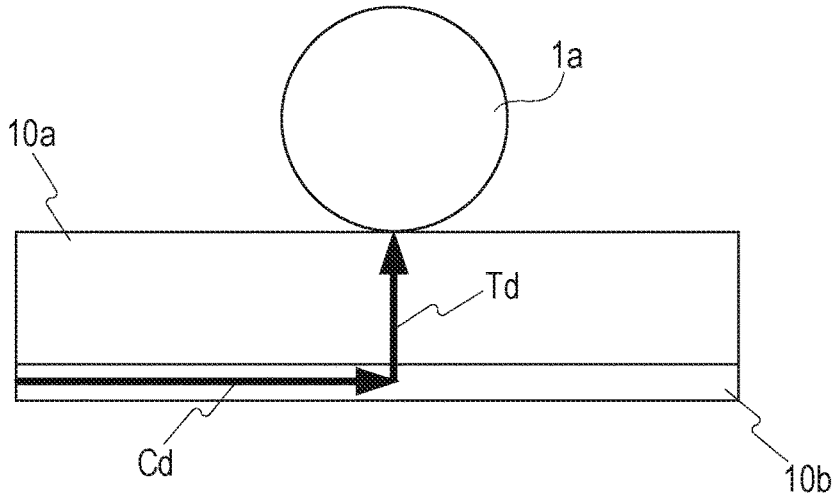
FIG. 8 is a schematic diagram for describing current flowing through the intermediate transfer belt to an image bearing member in the first embodiment.

Paths of electric current flowing toward the photosensitive drums 1*a* through 1*d* via the intermediate transfer belt 10 will be described below in detail, primarily by way of the current flowing toward the photosensitive drum 1*a*. FIG. 8 is a schematic diagram for describing a current flowing to the photosensitive drum 1*a* via the intermediate transfer belt 10 in the present embodiment. The current flowing from the opposed roller 13 maintained at Zener voltage through the intermediate transfer belt 10 flows through the inner layer 10*b* that has lower electrical resistance than the base layer 10*a*, in the direction of arrow Cd in FIG. 8 (circumferential direction of the intermediate transfer belt 10). At the first transfer portion where the photosensitive drum 1*a* and the intermediate transfer belt 10 come into contact, the current flows from the inner layer 10*b* toward the photosensitive drum 1*a* that is charged to a potential lower than the intermediate transfer belt 10, in the direction of the arrow Td in FIG. 8, which is the thickness direction of the base layer

10*a*. Accordingly, the toner image on the photosensitive drum 1*a* is transferred onto the intermediate transfer belt 10 by primary transfer.

The inner layer 10*b* has electronic conductivity, and the electrical resistance thereof changes little regardless of the ambient environment. Although the electrical resistance of the base layer 10*a* changes in accordance with the ambient environment due to having ionic conductivity, the length of the path of the current that flows through the base layer 10*a* is only a distance equivalent to the thickness of the base layer 10*a*, and this is shorter than the distance of the current flowing through the inner layer 10*b* in the direction of the arrow Cb in FIG. 8 in the present embodiment. Accordingly, the intermediate transfer belt 10 according to the present embodiment can suppress change in primary transfer voltage due to change in electrical resistance of the base layer 10*a* having ionic conductivity, as compared with the intermediate transfer belt according to comparative example 2. Accordingly, appropriate primary transfer voltage can be obtained at each image forming unit in the configuration of the present embodiment where primary transfer is performed by current flowing in the circumferential direction of the intermediate transfer belt 10, and occurrence of image defects can be suppressed.

The volume resistivity of the intermediate transfer belt 10 used in the present embodiment is in the range of $1\times10^{9}$ to $1\times10^{10}$ Ω·cm. The surface resistivity at the inner peripheral surface side is smaller than the surface resistivity at the outer peripheral surface side, and the surface resistivity of the inner peripheral surface side is in the range of $4.0\times10^{6}$ Ω/□ or less. The thicker the inner layer 10*b* is, the lower the surface resistivity at the inner peripheral surface side can be made to be, but if the inner layer 10*b* is too thick, this leads to cracking of the intermediate transfer belt 10 due to flexing, and separation of the inner layer 10*b* from the base layer 10*a*. Accordingly, the thickness of the inner layer 10*b* has been set to 3 μm in the present embodiment, taking this into consideration.

Figure 9:
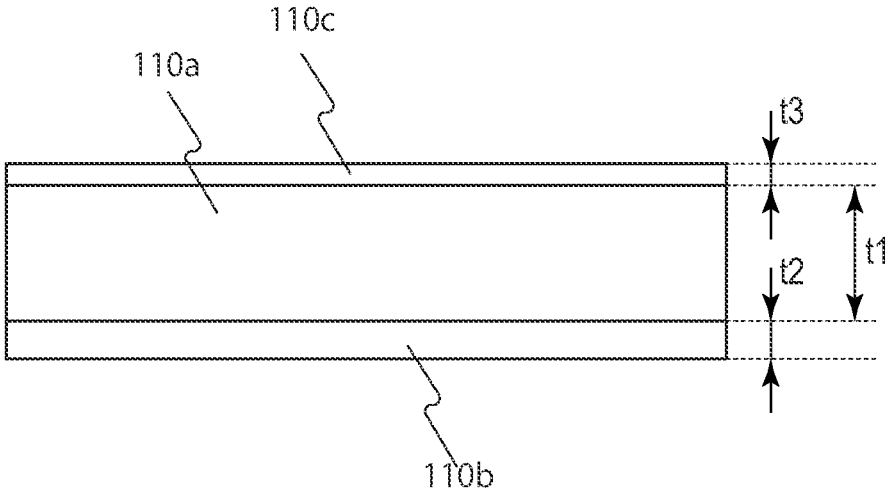
FIG. 9 is a schematic diagram for describing a cross-section of an intermediate transfer belt according to a modification.

Although the intermediate transfer belt 10 used in the present embodiment is configured of the two layers of the ion conductive base layer 10*a* and the electronically conductive inner layer 10*b*, the intermediate transfer belt 10 is not restricted to a two-layer configuration. FIG. 9 illustrates an example of a three-layer intermediate transfer belt 110 as a modification of the present embodiment, for example. The intermediate transfer belt 110 according to the modification has, in addition to a base layer 110*a* and an inner layer 110*b*, a surface layer 110*c* (third layer), as illustrated in FIG. 9. The surface layer 110*c* is configured at a position closer to the photosensitive drums 1*a* through 1*d* with regard to the thickness direction of the intermediate transfer belt 110.

An acrylic resin, polyester resin, or the like, into which a metal oxide or the like has been mixed as an electronically conductive agent, can be used as the surface layer 110*c*. An acrylic resin was used as the surface layer 110*c* in the example in FIG. 9. When the thickness of the surface layer 110*c* is defined as t3, t3=2 μm in the example in FIG. 9.

The surface resistivity of the intermediate transfer belt 110 as measured from the outer peripheral surface side reflects the electrical resistance of the surface layer 110*c*, and the surface resistivity measured from the outer peripheral surface side was $2.6\times10^{11}$Ω/□ in the modification. The surface resistivity measured from the inner peripheral surface side (inner layer 110*b* side) was $4.7\times10^{6}$ Ω/□. Even if the surface layer 110*c* has electronic conductivity as in the example in FIG. 9, transfer defects of independent path patterns such as described above at the secondary transfer portion do not readily occur if the electrical resistance is high. Additionally, the effects of change in electrical resistance at the ion conductive base layer 110*a* due to the ambient environment can be reduced, since the surface layer 110*c* has electronic conductivity. Note that the base layer 110*a* of the intermediate transfer belt 110 having a three-layer configuration can be measured by first shaving away the surface layer 110*c* or peeling the surface layer 110*c* away from the base layer 110*a*, and then measuring in the same way as with the base layer 10*a* of the intermediate transfer belt 10 in the first embodiment.

Material having ionic conductivity such as that of the base layer 110*a* in the present embodiment exhibits electrical conductivity due to ions in the material moving. Accordingly, long-term usage may result in imbalance in the ion conductive agent, resulting in bleeding of the ion conductive agent. Sandwiching the ion conductive base layer 110*a* by the surface layer 110*c* and inner layer 110*b*, from both the front and back sides as seen in the example in FIG. 9, can yield the effects of suppressing bleeding of the ion conductive agent.

Figure 10:
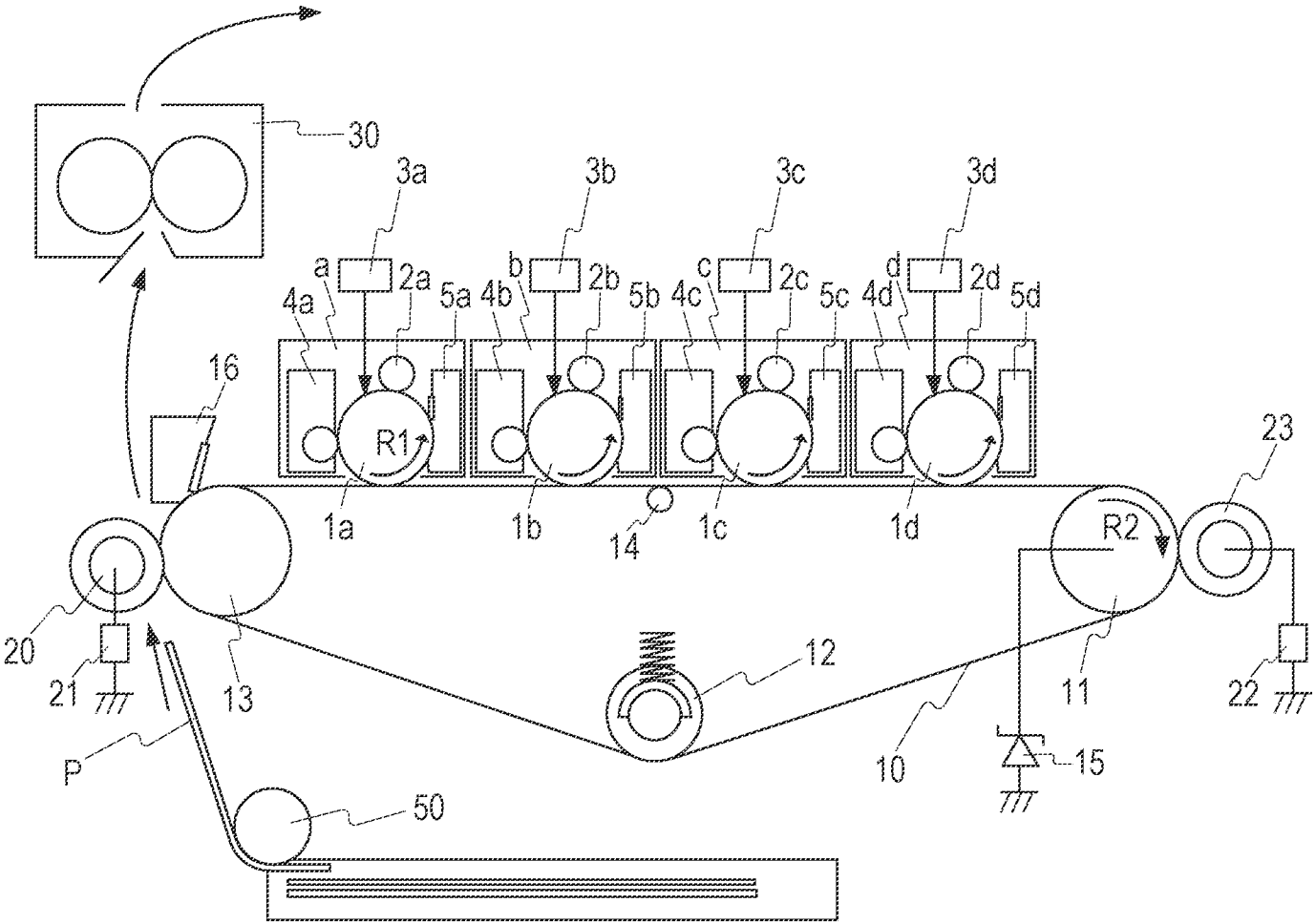
FIG. 10 is a schematic cross-sectional diagram, for describing an image forming apparatus according to another configuration of the first embodiment.

The present embodiment has been described as using the secondary transfer roller 20 as the current supply member. However, this is not restrictive, and an outer contact roller 23 that is different from the secondary transfer roller 20 may be used as the current supply member, as illustrated in FIG. 10, as long as the configuration is such that electric current can be made to flow in the circumferential direction of the intermediate transfer belt 10. FIG. 10 is a schematic cross-sectional diagram, for describing an image forming apparatus according to another configuration of the present embodiment. Voltage is applied to the outer contact roller 23 from a power source 22, and current flows to the Zener diode 15 via the drive roller 11 serving as the opposed member, as illustrated in FIG. 10, thereby generating Zener voltage at the cathode side of the Zener diode 15. Accordingly, the drive roller 11 connected to the cathode side of the Zener diode 15 is maintained at Zener voltage, current flows to the photosensitive drums 1*a* through 1*d* via the intermediate transfer belt 10, and toner images are transferred by primary transfer from the photosensitive drums 1*a* through 1*d* to the intermediate transfer belt 10.

Although the present embodiment has been described as using the Zener diode 15 as the voltage maintaining element, this is not restrictive. A resistance element or a varistor, which is a constant voltage element, may be used. Further, an arrangement may be made where the Zener diode 15 is not used, and current is supplied from the secondary transfer roller 20 to which voltage has been applied from the transfer power source 21, to the photosensitive drums 1*a* through 1*d* via the intermediate transfer belt 10. In this case, the current flowing from the secondary transfer roller 20 first flows in the thickness direction of the base layer 10*a* toward the inner layer 10*b* and then flows in the circumferential direction of the inner layer 10*b*, and finally flows from the inner layer 10*b* in the thickness direction of the base layer 10*a* toward the photosensitive drums 1*a* through 1*d* at each primary transfer portion.

Further, the present embodiment has been described as using the metal roller 14 as a contact member, this is not restrictive. A roller member having an electrical conductive elastic layer, an electrical conductive sheet member, an electrical conductive brush member, or the like, may be used.

Second Embodiment

Figure 11:
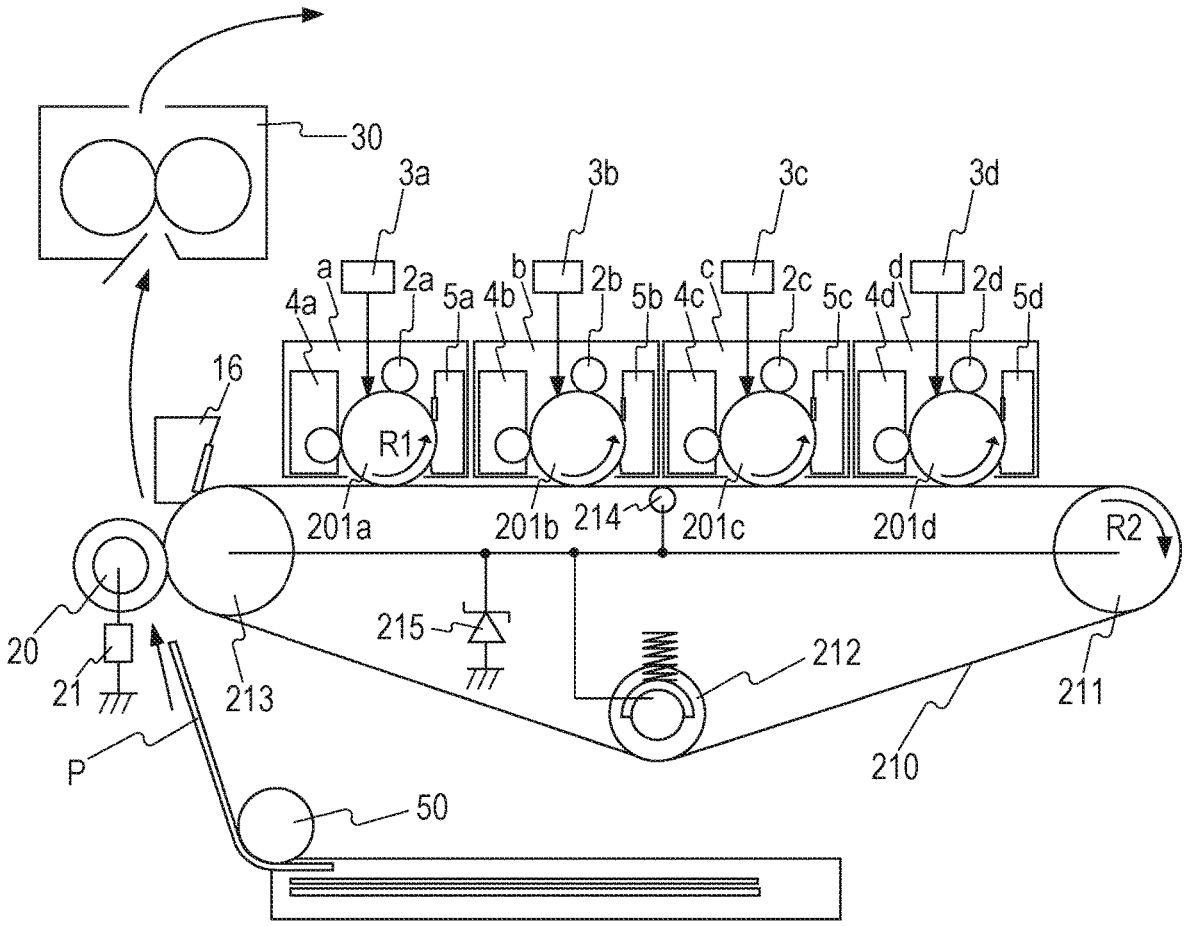
FIG. 11 is a schematic cross-sectional diagram for describing an image forming apparatus according to a second embodiment.

Description was made in the first embodiment of a configuration where electric current flows from the opposed roller 13 maintained at Zener voltage in the circumferential direction of the intermediate transfer belt 10, and toner images are transferred by primary transfer from the photosensitive drums 1*a* through 1*d* onto the intermediate transfer belt 10. Description will be made in contrast with this in a second embodiment as seen in FIG. 11. A Zener diode 215 is connected to the members in contact with the inner peripheral surface of an intermediate transfer belt 210 (drive roller 211, tension roller 212, opposed roller 213, and metal roller 214) in the configuration according to the second embodiment.

The intermediate transfer belt 210 is made up of a base layer 210*a* (first layer) having ionic conductivity and inner layer 210*b* (second layer) having electronic conductivity, in the same way as with the intermediate transfer belt 10 according to the first embodiment. The configuration of the intermediate transfer belt 210 is the same as that in the first embodiment, except that the surface resistivity of the inner peripheral surface side of the intermediate transfer belt 210 is $1.0\times10^7$ Ω/□. Configurations of the image forming apparatus according to the present embodiment that are the same as those in the first embodiment will be denoted with the same reference numerals, and description will be omitted.

FIG. 11 is a schematic cross-sectional diagram for describing the configuration of the image forming apparatus according to the present embodiment. One end side of the Zener diode 215 (anode side) is grounded in the configuration according to the present embodiment, as illustrated in FIG. 11. The other end side of the Zener diode 215 (cathode side) is connected to each of the drive roller 211 and tension roller 212 serving as tensioning members, the opposed roller 213 serving as an opposed member, and the metal roller 214 serving as a contact member. In this configuration, the voltage formed at the drive roller 211 and metal roller 214 situated near photosensitive drums 201*a* through 201*d* can be maintained at Zener voltage.

Accordingly, the current path on the inner layer 210*b* for the current flowing to the photosensitive drums 201*a* through 201*d* via the intermediate transfer belt 210 can be reduced in length as compared to the first embodiment. That is to say, current can be made to flow from the drive roller 211 and metal roller 214, maintained at Zener voltage, to the downstream image forming units farther away from the opposed roller 213, so good primary transferability can be obtained at the image forming units a through d. According to the present embodiment, good primary transferability can be ensured at the image forming units a through d, even in a case of using the intermediate transfer belt 210 that has a higher surface resistivity than the surface resistivity of the inner layer side of the intermediate transfer belt 10 according to the first embodiment.

Third Embodiment

Figure 12A:
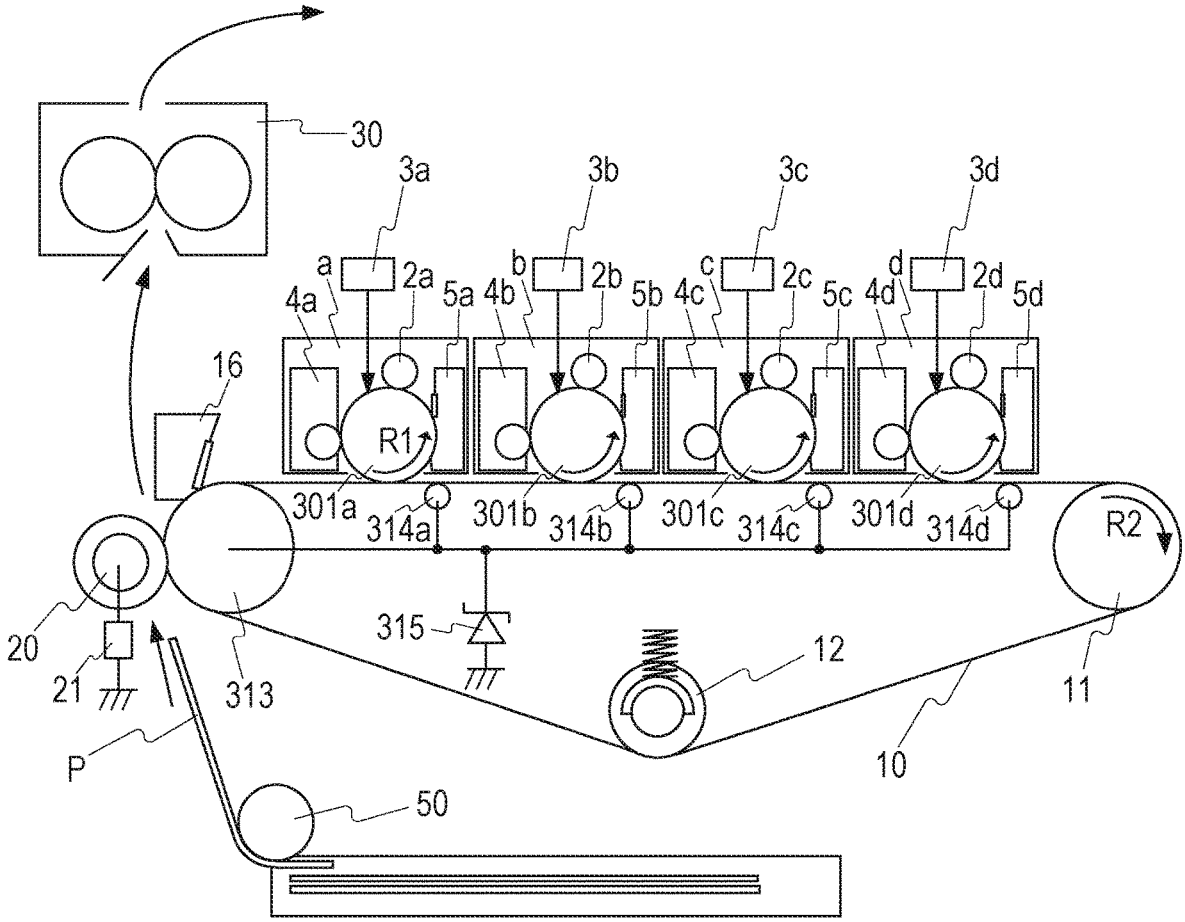
FIGS. 12A and 12B are schematic diagrams illustrating a third embodiment, where
Figure 12B:
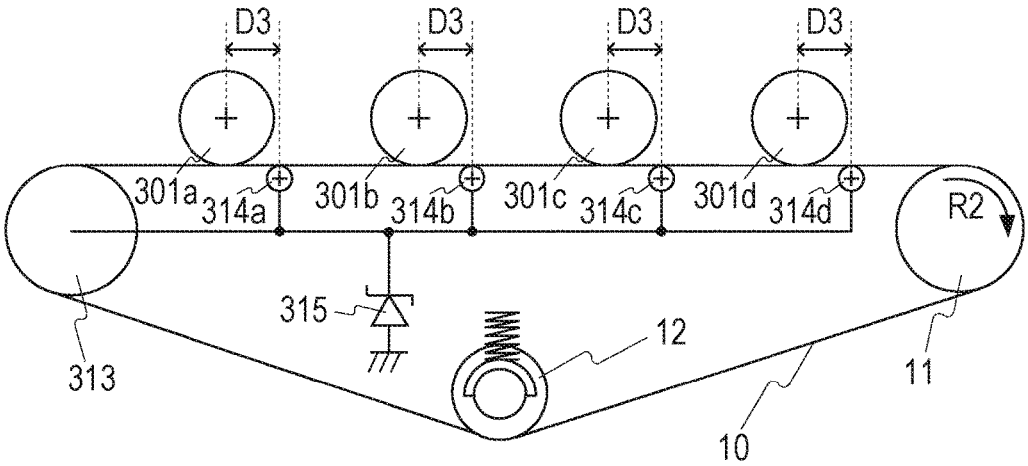

Description was made in the first embodiment regarding a configuration where the metal roller 14 serving as a contact member is disposed between the image forming unit b and the image forming unit c, and an electric current is made to flow from the opposed roller 13 maintained at Zener voltage in the circumferential direction of the intermediate transfer belt 10. In contrast with this, a description will be made in a third embodiment regarding a configuration where multiple metal rollers 314*a* through 314*d* that are electrically connected to a Zener diode 315 are disposed corresponding to the photosensitive drums 301*a* through 301*d*, as illustrated in FIGS. 12A and 12B. The configuration of the image forming apparatus according to the present embodiment is the same as that in the first embodiment, except that the multiple metal rollers 314*a* through 314*d* electrically connected to the Zener diode 315 are disposed corresponding to the photosensitive drums 301*a* through 301*d*. Accordingly, parts that are the same as those in the first embodiment will be denoted with the same reference numerals, and description will be omitted.

FIG. 12A is a schematic cross-sectional diagram for describing the configuration of the image forming apparatus according to the present embodiment. One end side of the Zener diode 315 (anode side) is grounded in the configuration according to the present embodiment, as illustrated in FIG. 12A. The other end side of the Zener diode 315 (cathode side) is connected to each of the opposed roller 313 serving as an opposed member, and the metal rollers 314*a* through 314*d* serving as contact members. In this configuration, the voltage formed at the opposed roller 313 and the metal rollers 314*a* through 314*d* can be maintained at Zener voltage when applying voltage from the transfer power source 21 to the secondary transfer roller 20.

FIG. 12B is a schematic diagram for describing the layout of the photosensitive drums 301*a* through 301*d* and the metal rollers 314*a* through 314*d*. It can be seen from FIG. 12B that the metal rollers 314*a* through 314*d* are each disposed on the downstream side of the respectively corresponding photosensitive drums 301*a* through 301*d*, by a distance D3, with respect to the movement direction of the intermediate transfer belt 10. This distance D3 is a distance from the axial centers of the metal rollers 314*a* through 314*d* to the axial centers of the respectively corresponding photosensitive drums 301*a* through 301*d*. Current flows from the metal rollers 314*a* through 314*d*, disposed near the photosensitive drums 301*a* through 301*d* and maintained at Zener voltage, to the photosensitive drums 301*a* through 301*d* via the intermediate transfer belt 10, in the present embodiment. Thus, the toner images are transferred by primary transfer from the photosensitive drums 301*a* through 301*d* to the intermediate transfer belt 10.

Accordingly, the same advantages as the first embodiment can be obtained from the present embodiment as well. The arrangement where the distances from the metal rollers 314*a* through 314*d* to the respective photosensitive drums 301*a* through 301*d* are equal distances enables current of generally the same magnitude to be applied to the photosensitive drums 301*a* through 301*d*. Accordingly, good primary transferability can be obtained at the image forming units a through d.

Fourth Embodiment

Figure 13A:
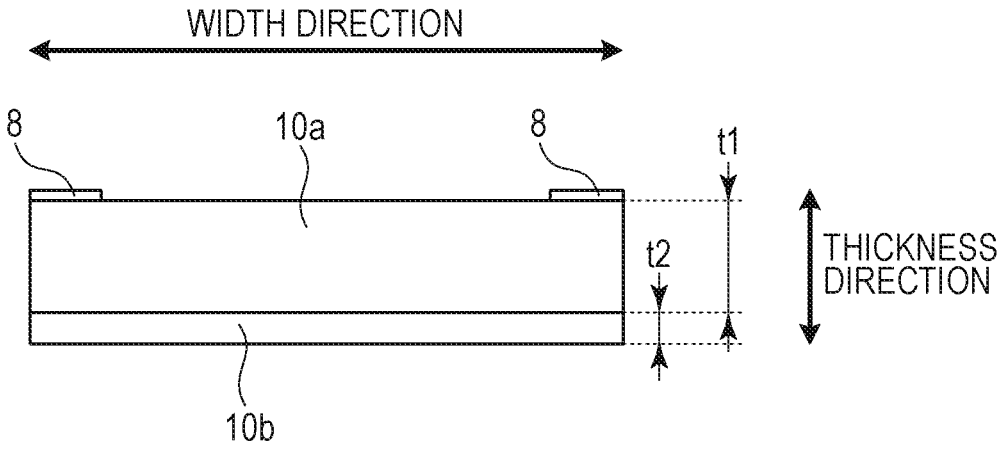
FIGS. 13A and 13B are schematic diagrams illustrating the first embodiment, where
Figure 13B:
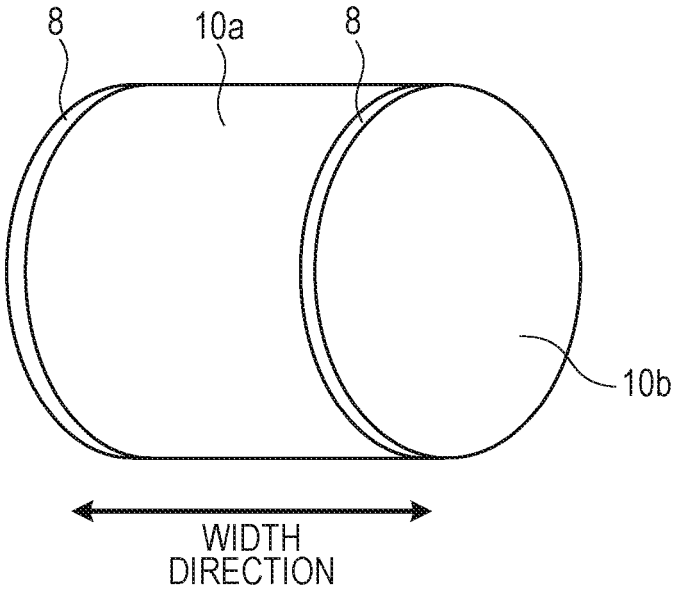

Description was made in the first embodiment regarding a configuration of the intermediate transfer belt 10 having the base layer 10*a* and inner layer 10*b*. In contrast with this, a description will be made in a fourth embodiment regarding a configuration where a protective member 8 is provided on the outer peripheral surface side with regard to the width direction of the intermediate transfer belt 10, as illustrated in FIGS. 13A and 13B. The intermediate transfer belt 10 is the same as that in the first embodiment except for the protective members 8 being provided at the edges of the base layer 10*a* side. Parts that are the same as those in the first embodiment will be denoted with the same reference numerals, and description will be omitted.

Occurrence of Wear at Surface of Photosensitive Drum

Figure 14:
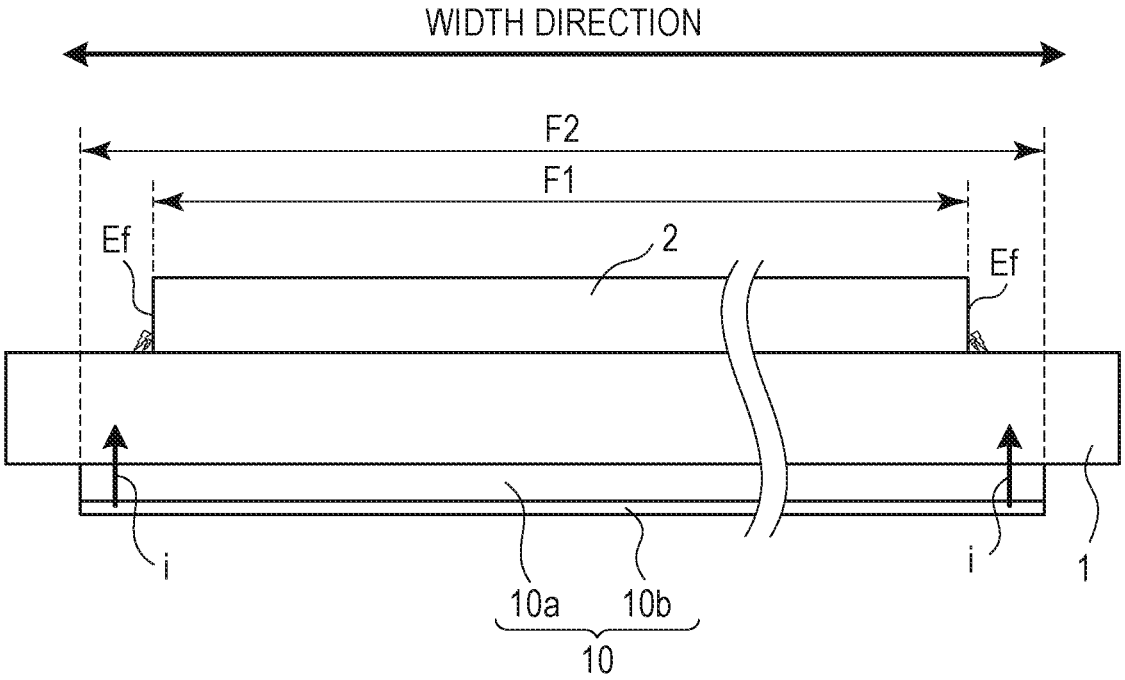
FIG. 14 is a schematic diagram for describing edge wear of the image bearing member due to discharge occurring between a charging roller and the image bearing member.

FIG. 14 is a schematic diagram for describing wear at the surface of a photosensitive drum 1, due to discharge occurring between a charging roller 2 and the photosensitive drum 1. The current flowing from the intermediate transfer belt 10 to the photosensitive drum 1 at this time also runs into the non-image region at the outer side of a region F1 where the charging roller 2 and the photosensitive drum 1 come into contact. Accordingly, the drum potential drops at both edges of the region F2 where the photosensitive drum 1 and intermediate transfer belt 10 come into contact, in addition to the image region where the photosensitive drum 1 can bear a toner image.

Thereafter, the photosensitive drum 1 is charged by receiving discharge from the charging roller 2 at a position of coming into contact with the charging roller 2. However, as a result of the drum potential at both edges of the region F2 having dropped at this time, the surface of the photosensitive drum 1 receives discharge from end surfaces Ef of the charging roller 2 at positions where both ends of the charging roller 2 come into contact with the photosensitive drum 1, i.e., at both edges of the region F1. Accordingly, both edges of the region F1 receive excessive discharge from the charging roller 2, which exacerbates deterioration and wear of the surface of the photosensitive drum 1. An insulating layer is formed on the surface of the photosensitive drum 1, so if wear of the surface progresses, there is a possibility that current may leak from the charging roller 2 toward the worn portions of the surface of the photosensitive drum 1. This may result in the charging voltage of the charging roller 2 dropping, leading to charging failure at the time of charging the surface of the photosensitive drum 1.

Protective Member

Accordingly, the protective member 8 is provided at the outer peripheral surface side of the intermediate transfer belt 10 in the present embodiment, thereby suppressing wear of the surface of the photosensitive drum 1 at both edges of the area F1 described above. FIG. 13A is a schematic cross-sectional view for describing the positional relationship between the intermediate transfer belt 10 and the protective member 8 according to the present embodiment, as viewed from the movement direction of the intermediate transfer belt 10. The protective members 8 are provided at both edges of the base layer 10*a* of the intermediate transfer belt 10, with respect to the width direction intersecting the movement direction of the intermediate transfer belt 10, as illustrated in FIG. 13A. FIG. 13B is a schematic diagram for describing the configuration of the intermediate belt and protective members 8. The protective members 8 are provided on the outer peripheral surface of the endless intermediate transfer belt 10, making one full circle at both edges of the intermediate transfer belt 10, as illustrated in FIG. 13B.

An electric insulation adhesive tape with a polyester base, made up of polyester film and an acrylic adhesive agent, is used for the protective member 8, with respect to the thickness direction. The intermediate transfer belt 10 is 53 μm thick and 8 mm wide. Note that in the present embodiment, the protective member 8 was applied in double at both sides of the outer peripheral surface of the intermediate transfer belt 10.

Figure 15:
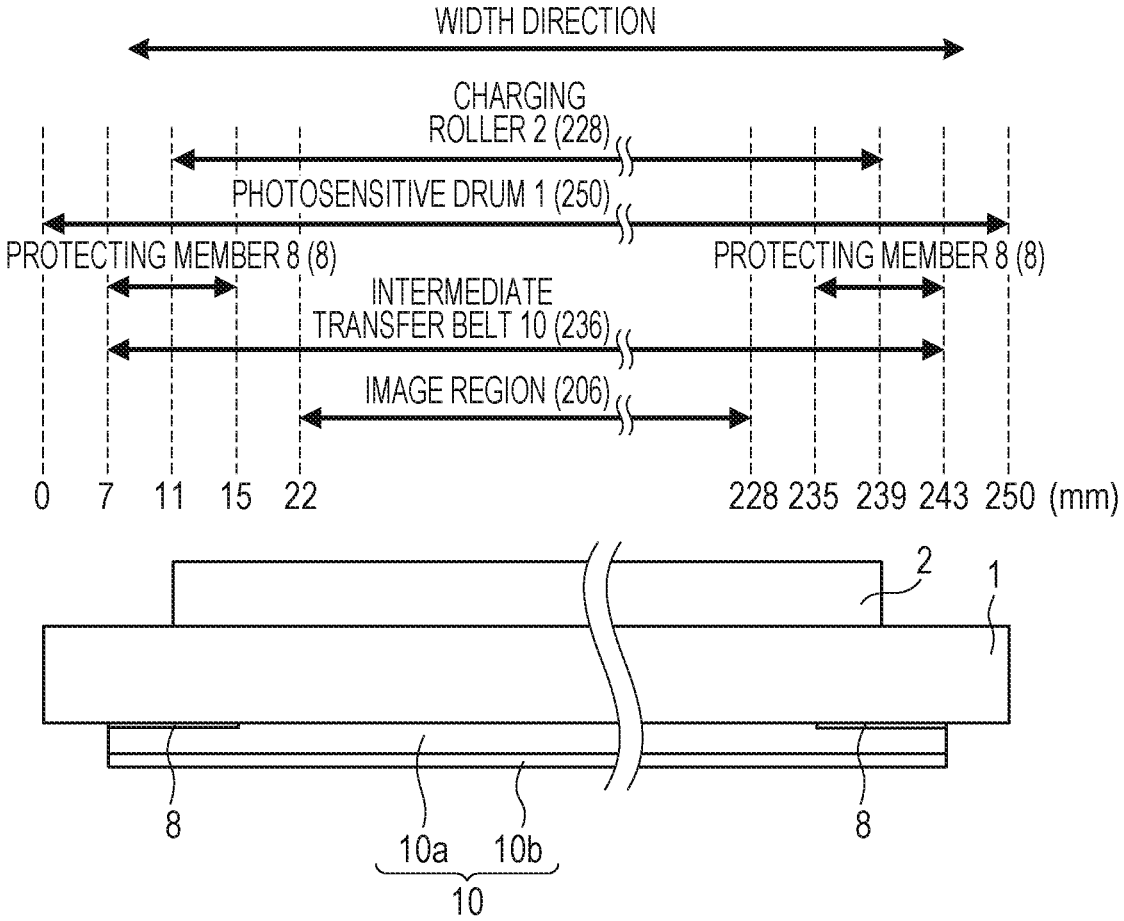
FIG. 15 is a schematic diagram for describing the relative positional relationship between each member and an image region, with regard to the width direction of the intermediate transfer belt in the first embodiment.

FIG. 15 is a schematic diagram for describing the relative positional relationship between the photosensitive drum 1, charging roller 2, protective member 8, intermediate transfer belt 10 and the length of the image region, with respect to the width direction of the intermediate transfer belt 10 according to the present embodiment, with one edge of the photosensitive drum 1 as a reference. The lengths of the photosensitive drum 1, charging roller 2, and intermediate transfer belt 10, in the width direction, are 250 mm, 228 mm, and 236 mm, respectively, as illustrated in FIG. 15. The length of the protective members 8 in the width direction is 8 mm, provided at both edges of the intermediate transfer belt 10.

The edges of the charging roller 2 are at the positions of 11 mm and 239 mm illustrated in FIG. 15, and the protective members 8 are applied at 7 mm to 15 mm and 235 mm to 243 mm. The region where the photosensitive drum 1 and intermediate transfer belt 10 come into direct contact is between 15 mm to 235 mm, including the image region. The regions of the photosensitive drum 1 where contact occurs with both edge portions of the charging roller 2 are the regions of the photosensitive drum 1 that come into contact with the protective members 8, as illustrated in FIG. 15.

The protective member 8 has insulating properties, so flowing of current from the inner layer 10*b* of the intermediate transfer belt 10 to the photosensitive drum 1 is suppressed at the regions where the protective members 8 and photosensitive drum 1 come into contact. The reason is that the volume resistivity of the protective members 8 is greater than the volume resistivity of the intermediate transfer belt 10, so current does not readily flow at the portions where the protective members 8 and photosensitive drum 1 come into contact. Accordingly, drop in drum potential at both edge portions of the region where the photosensitive drum 1 comes in contact with the charging roller 2 is suppressed, excessive discharge from the charging roller 2 is suppressed, and exacerbation of wear can be suppressed.

As described above, not only does the configuration according to the present embodiment yield the same advantages as the first embodiment, but exacerbation of wear of the surface of the photosensitive drum 1 can be suppressed, and occurrence of charging failure of the photosensitive drum 1 can be suppressed. Although a configuration has been described in the present embodiment where protective members 8 are provided to the intermediate transfer belt 10 having the base layer 10*a* and inner layer 10*b*, this is not restrictive, and protective members 8 may be provided to the intermediate transfer belt 110 having three or more layers, illustrated in the modification of the first embodiment.

Fifth Embodiment

Figure 16A:
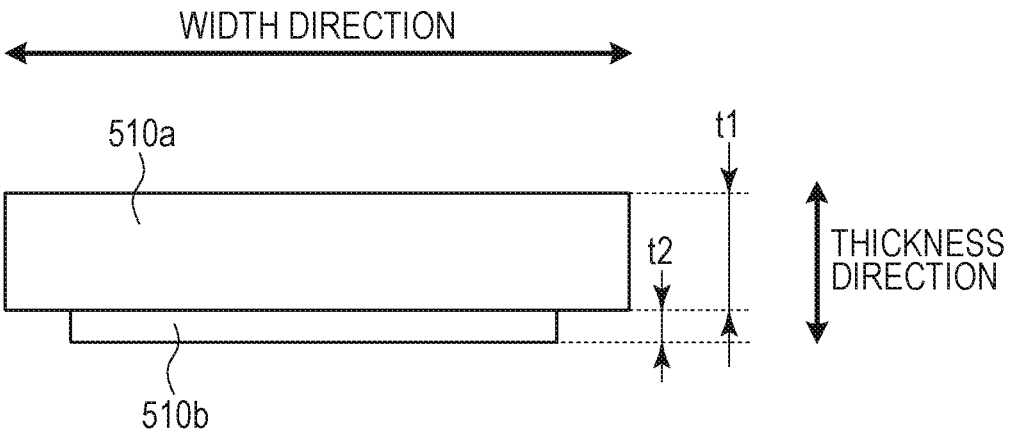
FIGS. 16A and 16B are schematic diagrams illustrating the second embodiment, where
Figure 16B:
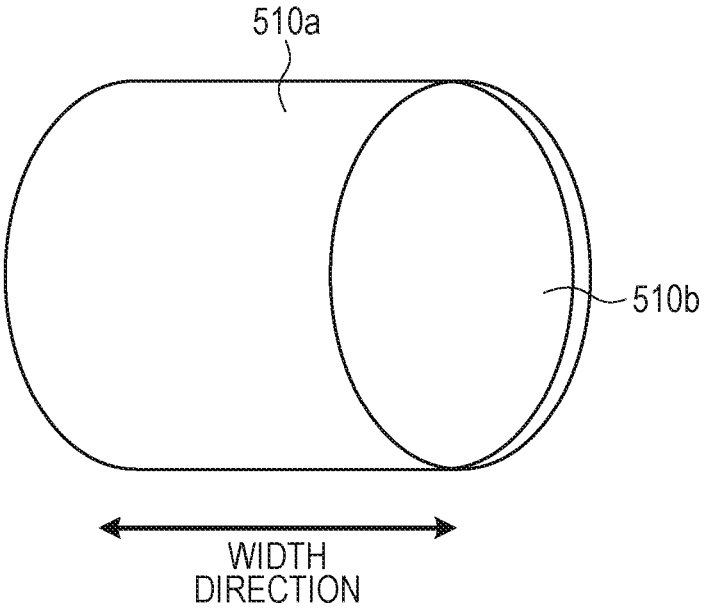

Description has been made in the fourth embodiment regarding a configuration where insulating protective members 8 are provided at both edges of the intermediate transfer belt 10 that has the inner layer 10*b* and comes in contact with the photosensitive drum 1. In contrast with this, a configuration will be described in a fifth embodiment where an intermediate transfer belt 510 does not have an inner layer 510*b* formed at either edge, as illustrated in FIGS. 16A and 16B. The configuration according to the present embodiment is the same as that in the fourth embodiment except for the point that the inner layer 510*b* is not formed at both edges of the intermediate transfer belt 510, and the point that the protective member 8 is not provided. Accordingly, members that are the same as those in the fourth embodiment will be denoted with the same reference numerals, and description will be omitted.

FIG. 16A is a schematic diagram for describing a cross-section of the intermediate transfer belt 510 as viewed from the direction of movement of the intermediate transfer belt 510 in the present embodiment. It can be seen from FIG. 16A that the inner layer 510*b* is not formed at the edges of the intermediate transfer belt 510 with respect to the width direction that intersects the direction of movement of the intermediate transfer belt 510. The intermediate transfer belt 510 with no inner layer 510*b* formed at both edges was obtained in the present embodiment by masking both edges of a base layer 510*a* when forming the inner layer 510*b* (second layer) on the base layer 510*a* (first layer) by spray coating.

Note that in the present embodiment, there is an 8-mm wide region from both edges of the intermediate transfer belt 510 toward the center of the intermediate transfer belt 510 where the inner layer 510*b* is not formed, with respect to the width direction of the intermediate transfer belt 510. FIG. 16B is a schematic diagram for describing the configuration of the intermediate transfer belt 510 according to the present embodiment. It can be seen from FIG. 16B that the inner layer 510*b* is not formed at both edges of the intermediate transfer belt 510 over the full circle of the intermediate transfer belt 510.

Figure 17:
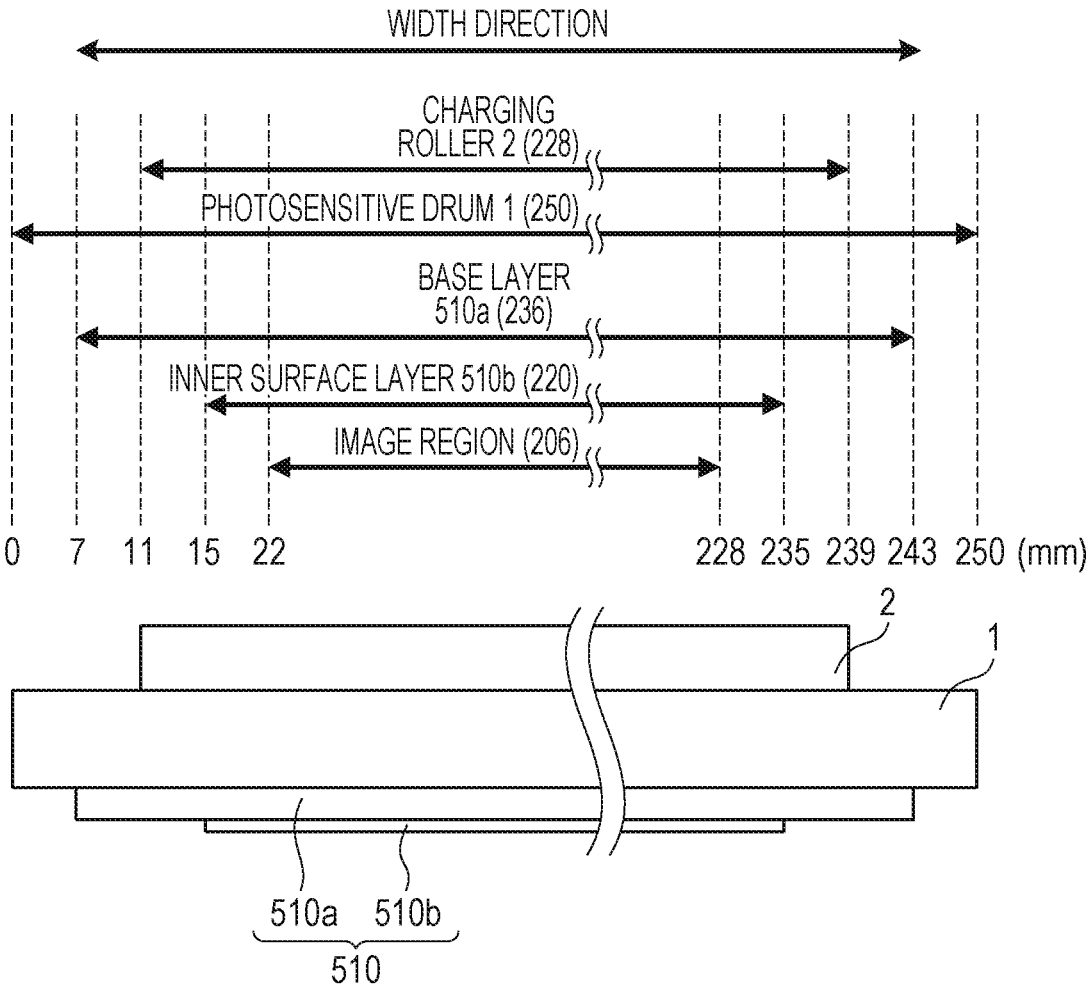
FIG. 17 is a schematic diagram for describing the relative positional relationship between each member and an image region, with regard to the width direction of the intermediate transfer belt in the second embodiment.

FIG. 17 is a schematic diagram for describing the relative positional relationship between the photosensitive drum 1, charging roller 2, intermediate transfer belt 510 and the length of the image region, with respect to the width direction of the intermediate transfer belt 510 according to the present embodiment, with one edge of the photosensitive drum 1 as a reference. The lengths of the photosensitive drum 1, charging roller 2, and base layer 510*a* and inner layer 510*b* of the intermediate transfer belt 510, in the width direction, are 250 mm, 228 mm, 236 mm, and 220 mm, respectively, as illustrated in FIG. 17.

The ends of the charging roller 2 are situated at the positions of 11 mm and 239 mm in FIG. 17. The inner layer 510*b* is not formed at 7 mm to 15 mm and 235 mm to 243 mm, and is formed on the base layer 510*a* between 15 mm and 235 mm. That is to say, the region where the portion of the intermediate transfer belt 510 where the inner layer 510*b* is formed and photosensitive drum 1 come into direct contact is between 15 mm and 235 mm including the image region. Note that the regions of the photosensitive drum 1 that come into contact with both end portions of the charging roller 2 agree with the regions of the intermediate transfer belt 510 where the inner layer 510*b* is not formed.

The intermediate transfer belt 510 according to the present embodiment has the inner layer 510*b* with lower electrical resistance than the base layer 510*a* in the same way as the intermediate transfer belt 10 according to the first embodiment. Accordingly, the current flowing from the intermediate transfer belt 510 to the photosensitive drum 1 flows in the circumferential direction of the inner layer 510*b* and thereafter flows in the thickness direction of the base layer 510*a*, from the inner layer 510*b* toward the photosensitive drum 1 at the position where the intermediate transfer belt 510 and the photosensitive drum 1 come into contact. Thus, according to the configuration of the present embodiment, current is suppressed from flowing to both edges of the intermediate transfer belt 510 where the inner layer 510*b* is not formed. Accordingly, drop in drum potential can be suppressed at both edge portions of the region where the charging roller 2 and photosensitive drum 1 come into contact. As a result, occurrence of excessive discharge from the charging roller 2 can be suppressed, and exacerbation of wear of the surface of the photosensitive drum 1 can be suppressed.

As described above, advantages the same as the fourth embodiment can be obtained by the configuration according to the present embodiment. Also, the inner layer 510*b* was not formed in the range of 8 mm from both edge portions of the intermediate transfer belt 510 in the present embodiment, with respect to the width direction of the intermediate transfer belt 510. However, this is not restrictive, and advantages the same as the present embodiment can be obtained with an intermediate transfer belt 510 where the inner layer 510*b* is not formed at regions where excessive discharge from the charging roller 2 might occur. That is to say, it is sufficient for the inner layer 510*b* not to be formed at least at positions corresponding to both edges of the region where the charging roller 2 and photosensitive drum 1 come into contact.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus, comprising:

an image bearing member configured to bear a toner image;

a movable endless intermediate transfer belt that has electrical conductivity and is configured of a plurality of layers;

first, second, and third rollers around which the intermediate transfer belt is stretched, wherein the image bearing member is in contact with a stretch surface of the intermediate transfer belt stretched between the first roller and the second roller, and the third roller stretches the intermediate transfer belt at a position of not being in contact with the stretch surface;

a secondary transfer member configured to be in contact with an outer peripheral surface of the intermediate transfer belt at a position facing the first roller, and configured to transfer a toner image from the intermediate transfer belt onto a transfer medium after the toner image is transferred from the image bearing member to the intermediate transfer belt; and a power source configured to apply voltage to the secondary transfer member for transferring the toner image, wherein an electric current is made to flow in a circumferential direction of the intermediate transfer belt, the circumferential direction being a direction along a moving direction of the intermediate transfer belt, and wherein the plurality of layers of the intermediate transfer belt includes a first layer that has ionic conductivity and is a thickest layer out of the plurality of layers making up the intermediate transfer belt with respect to the thickness direction of the intermediate transfer belt, and a second layer that has electronic conductivity and lower electrical resistance than the first layer, the second layer being an innermost layer among the plurality of layers and having a surface resistivity in a range of $4.0\times10^6$ Ω/□ or less.

2. The image forming apparatus according to claim 1, wherein the first layer comes into contact with the image bearing member.

3. The image forming apparatus according to claim 1, wherein the plurality of layers includes a third layer that has higher electrical resistance than the first layer, and the third layer is in contact with the image bearing member.

4. The image forming apparatus according to claim 3, wherein the third layer has electronic conductivity.

5. The image forming apparatus according to claim 1, wherein the first roller is an opposed member opposing the secondary transfer member, the opposed member opposing the secondary transfer member across the intermediate transfer belt, and wherein the second layer is formed at a position farther away from the image bearing member than the first layer with respect to the thickness direction, and comes into contact with the opposed member.

6. The image forming apparatus according to claim 5, wherein the toner image is transferred from the image bearing member to the intermediate transfer belt when an electric current flows from the secondary transfer member toward the opposed member, and the toner image is transferred from the intermediate transfer belt to the transfer medium when an electric current flows from the secondary transfer member toward the opposed member.

7. The image forming apparatus according to claim 6, wherein the electric current that flows from the opposed member toward the image bearing member in the circumferential direction of the intermediate transfer belt, flows through the second layer, and thereafter flows through the first layer to the image bearing member.

8. The image forming apparatus according to claim 5, further comprising:

a voltage maintaining element that is capable of maintaining a predetermined voltage by being supplied with electric current from the opposed member, wherein one end of the voltage maintaining element is grounded, and the other end of the voltage maintaining element is connected to the opposed member.

9. The image forming apparatus according to claim 8, wherein the electric current flows from the opposed member maintained at the predetermined voltage in the circumferential direction of the intermediate transfer belt toward the image bearing member, by the electric current flowing from the secondary transfer member to the voltage maintaining element via the opposed member.

10. The image forming apparatus according to claim 8, wherein the voltage maintaining element is a Zener diode.

11. The image forming apparatus according to claim 5, further comprising:

a contact member configured to come into contact with the second layer of the intermediate transfer belt, and disposed near the image bearing member, wherein the contact member is electrically connected with the opposed member.

12. The image forming apparatus according to claim 11, wherein a plurality of the image bearing member and a plurality of the contact member are provided, with respect to the direction of movement of the intermediate transfer belt, the plurality of contact members each being disposed corresponding to the plurality of image bearing members.

13. The image forming apparatus according to claim 12, wherein each of the plurality of contact members is disposed at a downstream side of a position where the image bearing member to which the contact member corresponds comes into contact with the intermediate transfer belt, with respect to the direction of movement of the intermediate transfer belt.

14. The image forming apparatus according to claim 12, wherein a distance between an axial center of each of the plurality of image bearing members and an axial center of the corresponding contact member of the plurality of contact members is equal among all corresponding sets of image bearing members and contact members.

15. The image forming apparatus according to claim 11, wherein the contact member is a metal roller.

16. The image forming apparatus according to claim 1, further comprising:

a charging member configured to come into contact with the image bearing member and charge the image bearing member, a length of the charging member in a width direction intersecting the direction of movement of the intermediate transfer belt being shorter than a length of the image bearing member; and a protective member disposed between the image bearing member and the intermediate transfer belt with respect to the thickness direction, the electrical resistance of the protective member being greater than that of the first layer, wherein the protective member is disposed at a position at least corresponding to both end portions of a region where the charging member and the image bearing member come into contact, with respect to the width direction.

17. The image forming apparatus according to claim 16, wherein the protective member is at least provided from both edges of the region where the charging member and the image bearing member come into contact to both edge portions of the intermediate transfer belt, on the outer side of an image region where the image bearing member can bear a toner image, with respect to the width direction.

18. The image forming apparatus according to claim 1, further comprising:

a charging member configured to come into contact with the image bearing member and charge the image bearing member, a length of the charging member in a width direction intersecting the direction of movement of the intermediate transfer belt being shorter than a length of the image bearing member, wherein the second layer is not formed at least at positions corresponding to both edge portions of a region where the charging member and the image bearing member come into contact, with respect to the width direction.

19. The image forming apparatus according to claim 18, wherein the second layer is not formed at least from the both edge portions of the region where the charging member and the image bearing member come into contact to both edge portions of the intermediate transfer belt, on the outer side of an image region where the image bearing member can bear a toner image, with respect to the width direction.

20. The image forming apparatus according to claim 1, wherein in a state the power source applying voltage to the secondary transfer member, the electric current that is going toward the image bearing member flows through the first layer after flowing in the second layer in the circumferential direction of the intermediate transfer belt, and, by the flow of the electric current, a toner image is transferred by the primary transfer from the image bearing member to the intermediate transfer belt.

* * * * *